US007936309B2

(12) United States Patent
Lindenmeier et al.

(10) Patent No.: US 7,936,309 B2
(45) Date of Patent: May 3, 2011

(54) ANTENNA FOR SATELLITE RECEPTION

(75) Inventors: Stefan Lindenmeier, Gauting (DE); Heinz Lindenmeier, Planegg (DE); Jochen Hopf, Haar (DE); Leopold Reiter, Gilching (DE)

(73) Assignee: Delphi Delco Electronics Europe GmbH, Wuppertal (DE)

( * ) Notice: Subject to any disclaimer, the term of this patent is extended or adjusted under 35 U.S.C. 154(b) by 112 days.

(21) Appl. No.: 12/206,284

(22) Filed: Sep. 8, 2008

(65) Prior Publication Data

US 2009/0073072 A1 Mar. 19, 2009

(30) Foreign Application Priority Data

Sep. 6, 2007 (DE) ..... 10 2007 042 446
Jan. 8, 2008 (DE) ..... 10 2008 003 532

(51) Int. Cl.
*H01Q 21/00* (2006.01)

(52) U.S. Cl. ..... 343/725; 343/728; 343/741; 343/866

(58) Field of Classification Search ..... 343/725, 343/726, 727, 728, 741, 742, 866, 867
See application file for complete search history.

(56) References Cited

U.S. PATENT DOCUMENTS 2,283,897 A 5/1942 Alford
3,605,097 A * 9/1971 Hadik-Barkoczy ..... 343/739
3,942,119 A 3/1976 Meinke et al.
4,070,677 A 1/1978 Meinke et al.
4,095,228 A 6/1978 Meinke et al.
(Continued)

FOREIGN PATENT DOCUMENTS

DE 865 478 2/1953
(Continued)

OTHER PUBLICATIONS

Alois Krischke "Rothammels Antennenbuch" 2002, DARC Verlag, Baunatal XP002545079, p. 525 + translation.

*Primary Examiner* — Tho G Phan
(74) *Attorney, Agent, or Firm* — Jimmy L. Funke

(57) ABSTRACT

There is disclosed an antenna for reception of circularly polarized satellite radio signals. The antenna comprises at least one two-dimensional or three-dimensional antenna conductor structure connected with an antenna output connector. The multi-dimensional antenna conductor structure is configured so that it comprises a plurality of antenna conductor sections, which, with reference to a spatial reference point (z) common to the antenna conductor sections, are disposed in pairs, symmetrically and extending in the same direction. The multi-dimensional antenna conductor structure is furthermore configured so that during reciprocal operation of the antenna as a transmission antenna, antenna currents having at least approximately the same size flow in the individual pairs of antenna conductor sections, and the arithmetical average of the current phases of these antenna currents, counted in the same direction, in each instance, in the antenna conductor sections of each pair, has at least approximately the same value in the case of essentially all the pairs of antenna conductor sections, with reference to a common phase reference point (B), during reciprocal operation of the antenna as a transmission antenna. Such an antenna receives left-rotating circularly polarized waves and right-rotating circularly polarized waves equally. The vertical radiation diagram can be filled up towards low elevation angles by means of a vertical, electrically short monopole disposed at the phase reference point (B), whose reception signal is superimposed on that of the antenna conductor structure.

27 Claims, 26 Drawing Sheets

U.S. PATENT DOCUMENTS

| | | | | | |
|---|---|---|---|---|---|
| 4,433,336 | A | * | 2/1984 | Carr | 343/728 |
| 4,547,776 | A | | 10/1985 | Bolt, Jr. et al. | |
| 4,602,260 | A | | 7/1986 | Lindenmeier et al. | |
| 4,752,968 | A | | 6/1988 | Lindenmeier et al. | |
| 4,791,426 | A | | 12/1988 | Lindenmeier et al. | |
| 4,914,446 | A | | 4/1990 | Lindenmeier et al. | |
| 5,029,308 | A | | 7/1991 | Lindenmeier et al. | |
| 5,049,892 | A | | 9/1991 | Lindenmeier et al. | |
| 5,097,270 | A | | 3/1992 | Lindenmeier et al. | |
| 5,138,330 | A | | 8/1992 | Lindenmeier et al. | |
| 5,266,960 | A | | 11/1993 | Lindenmeier et al. | |
| 5,289,197 | A | | 2/1994 | Lindenmeier et al. | |
| 5,300,936 | A | * | 4/1994 | Izadian | 343/700 MS |
| 5,313,660 | A | | 5/1994 | Lindenmeier et al. | |
| 5,589,839 | A | | 12/1996 | Lindenmeier et al. | |
| 5,619,214 | A | | 4/1997 | Lindenmeier et al. | |
| 5,751,252 | A | | 5/1998 | Phillips | |
| 5,801,663 | A | | 9/1998 | Lindenmeier et al. | |
| 5,818,394 | A | | 10/1998 | Aminzadeh et al. | |
| 5,826,179 | A | | 10/1998 | Lindenmeier et al. | |
| 5,850,198 | A | | 12/1998 | Lindenmeier et al. | |
| 5,905,469 | A | | 5/1999 | Lindenmeier et al. | |
| 5,926,141 | A | | 7/1999 | Lindenmeier et al. | |
| 5,929,812 | A | | 7/1999 | Aminzadeh | |
| 5,949,498 | A | | 9/1999 | Rudolph | |
| 5,973,648 | A | | 10/1999 | Lindenmeier et al. | |
| 6,011,962 | A | | 1/2000 | Lindenmeier et al. | |
| 6,123,550 | A | | 9/2000 | Burkert et al. | |
| 6,130,645 | A | | 10/2000 | Lindenmeier et al. | |
| 6,140,969 | A | | 10/2000 | Lindenmeier et al. | |
| 6,169,888 | B1 | | 1/2001 | Lindenmeier et al. | |
| 6,184,837 | B1 | | 2/2001 | Lindenmeier et al. | |
| 6,188,447 | B1 | | 2/2001 | Rudolph et al. | |
| 6,218,997 | B1 | | 4/2001 | Lindenmeier et al. | |
| 6,236,372 | B1 | | 5/2001 | Lindenmeier et al. | |
| 6,313,799 | B1 | | 11/2001 | Thimm et al. | |
| 6,317,096 | B1 | | 11/2001 | Daginnus et al. | |
| 6,377,221 | B1 | | 4/2002 | Lindenmeier et al. | |
| 6,400,334 | B1 | | 6/2002 | Lindenmeier et al. | |
| 6,421,532 | B1 | | 7/2002 | Lindenmeier et al. | |
| 6,430,404 | B1 | | 8/2002 | Lindenmeier et al. | |
| 6,574,460 | B1 | | 6/2003 | Lindenmeier et al. | |
| 6,603,434 | B2 | | 8/2003 | Lindenmeier et al. | |
| 6,603,435 | B2 | | 8/2003 | Lindenmeier et al. | |
| 6,611,677 | B1 | | 8/2003 | Lindenmeier et al. | |
| 6,633,258 | B2 | | 10/2003 | Lindenmeier et al. | |
| 6,653,982 | B2 | | 11/2003 | Lindenmeier et al. | |
| 6,768,457 | B2 | | 7/2004 | Lindenmeier | |
| 6,888,508 | B2 | | 5/2005 | Lindenmeier | |
| 6,911,946 | B2 | | 6/2005 | Lindenmeier | |
| 6,917,340 | B2 | | 7/2005 | Lindenmeier | |

FOREIGN PATENT DOCUMENTS

| | | |
|---|---|---|
| DE | 4008505 | 9/1991 |
| DE | 10163793 | 9/2002 |
| DE | 20 2005 015708 | 12/2005 |
| EP | 1 445 832 | 8/2004 |
| GB | 194365 | 3/1923 |
| JP | 57 063941 | 4/1982 |
| JP | 2000 077934 | 3/2000 |

* cited by examiner

ANTENNA FOR SATELLITE RECEPTION

CROSS REFERENCE TO RELATED APPLICATIONS

This application is a U.S. application that claims priority from German Applications 10 2007 042 446.0 filed on Sep. 6, 2007 and DE102008003532.7 filed on Jan. 8, 2008 wherein the disclosures of these two applications are hereby incorporated herein by reference in their entirety.

BACKGROUND

The invention relates to an antenna for the reception of circularly polarized satellite radio signals.

Particularly in the case of satellite radio systems, what is particularly important is the efficiency of the transmission output emitted by the satellite, and the efficiency of the reception antenna. Satellite radio signals are generally transmitted with circularly polarized electromagnetic waves, because of polarization rotations on the transmission path. In many cases, program contents are transmitted on separate frequency bands that lie close to one another in frequency. This is done, using the example of SDARS satellite radio, at a frequency of approximately 2.3 GHz, in two adjacent frequency bands, each having a bandwidth of 4 MHz, at a distance between the center frequencies of 8 MHz and 4 MHz, respectively. The signals are emitted by different satellites, with an electromagnetic wave that is circularly polarized in one direction. Accordingly, circularly polarized antennas are used for reception in the corresponding direction. Such antennas are known, for example, from DE-A-4008505 and DE-A-10163793. This satellite radio system is additionally supported by means of the transmission of terrestrial signals, in certain areas, in another frequency band having the same bandwidth, disposed between the two satellite signals.

In the case of a satellite radio system in which signals in frequency bands that lie close to one another. in frequency, and have approximately the same width, but the circularly polarized waves must be emitted in opposite directions of rotation. These differently circularly polarized antennas would accordingly have to be used for the reception of the two frequency bands, for example, according to the patterns of the embodiments known from DE-A-4008505 and DE-A-10163793. For reception in vehicles, in particular, the use of multiple antennas having separate lines to the receiver, i.e. the use of a complicated switching device for selective reception of the one or the other signal, is economically complicated and therefore disadvantageous. Separate processing of the two frequency bands, using frequency-selective measures, within one and the same antenna, cannot be achieved with efficient means, because of the great selection requirement.

SUMMARY

At least one embodiment of the invention relates to an antenna that is suitable for reception of the electromagnetic waves emitted in both satellite frequency bands, both with left-rotating (LHCP) and with right-rotating circular polarization (RCHP), and that possesses approximately the same radiation characteristics, suitable for satellite reception, at its antenna connection point. Furthermore, it is supposed to be possible to configure the antenna in efficient manner.

In at least one embodiment, the antenna for the reception of circularly polarized satellite radio signals comprises a multi-dimensional such as at least one two-dimensional or three-dimensional antenna conductor structure connected with an antenna output connector. The multi-dimensional antenna conductor structure is configured so that it essentially comprises a plurality of antenna conductor sections, which, with reference to a spatial reference point common to the antenna conductor sections, are disposed symmetrically in pairs and extending in the same direction. The multi-dimensional antenna conductor structure is furthermore configured so that in the case of reciprocal operation of the antenna as a transmission antenna, antenna currents having at least approximately the same size flow in the individual pairs of antenna conductor sections, and the arithmetical average of the current phases of the antenna currents, counted in the antenna conductor sections of each pair, in the same direction, in each instance, has at least approximately the same value, in the case of essentially all the pairs of antenna conductor sections, with reference to a common phase reference point.

Such an antenna is able to equally receive left-rotating circularly polarized waves and right-rotating circularly polarized waves, and can be implemented by means of relatively simple antenna conductor structures, also for elevation angles of the radiation diagram suitable for reception of satellite signals.

The distribution of the currents to an antenna in reception operation is dependent on the terminating resistance at the antenna connection point. In contrast to this, in transmission operation, the distribution of the currents to the antenna conductor, with reference to the feed current at the antenna connection point, is independent of the source resistance of the feeding signal source, and is thus clearly linked with the directional diagram and the polarization of the antenna. Because of this unambiguousness in connection with the law of reciprocity, according to which the radiation properties—such as directional diagram and polarization—are identical both in transmission operation and in reception operation, the task according to the invention, with regard to polarization and directional diagrams, is accomplished using the configuration of the antenna structure, to generate corresponding currents in transmission operation of the antenna. Thus, the task according to the invention is also accomplished for reception operation. All the deliberations below, with regard to currents on the antenna structure and their phases, i.e. their phase reference point, therefore relate to reciprocal operation of the reception antenna as a transmission antenna, unless reception operation is explicitly mentioned.

For example, in this case, in at least one embodiment, there is an antenna for reception of circularly polarized satellite radio signals. This antenna comprises a multi-dimensional antenna conductor structure (14). There is also at least one antenna output connector, connected to the multi-dimensional antenna conductor structure. The multi-dimensional antenna conductor structure comprises a plurality of antenna conductor sections ($\Delta_v$), which, with reference to a spatial reference point common to the antenna conductor sections ($\Delta_v$), are disposed in pairs, symmetrically and extending in the same direction. The multi-dimensional antenna conductor structure is furthermore configured so that during reciprocal operation of the antenna as a transmission antenna, antenna currents having at least approximately the same size flow in the individual pairs of antenna conductor sections ($\Delta_v$), and the arithmetical average of the current phases of these antenna currents, counted in the same direction, in each instance, in the antenna conductor sections ($\Delta_v$) of each pair, has at least approximately the same value in the case of essentially all the pairs of antenna conductor sections ($\Delta_v$), with reference to a common phase reference point.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION

Although the task according to the invention is directed at a reception antenna, in the following, the properties of the antenna will be described for reciprocal operation of the antenna as a transmission antenna, for reasons of better comprehensibility, but of course, since the reciprocity relationship applies, the transmission case also applies to the reception case.

A particular advantage of an antenna according to the invention is the property that while it is true that the electrical field intensity vector generated in the reception field, in the case of operation of the antenna as a transmission antenna, in accordance with the reciprocity law, is polarized at every point in space, at every point in time, along a fixed straight line specific to this point in space, but with regard to the direction of this line in space, there is no equality requirement for the different spatial directions of the radiation diagram, as it is known for radio transmission with linearly polarized antennas. Of course, this line always stands perpendicular on the direction of propagation, but with regard to its other direction, it can be configured with complete freedom, according to one embodiment of the invention. This results in a great variety in possible configurations, which allows optimal adaptation to a required radiation characteristic. For configuration of the antenna according to the invention, all that is necessary is to exclude a temporal change in the direction of the electrical and therefore magnetic field intensity vector over the period of high-frequency oscillation, for reciprocal operation as a transmission antenna in every spatial direction. Spatial directions in which this requirement is not met always contribute to supporting one of the two satellite signals, and therefore necessarily weakening the other satellite signal, and thereby weaken the overall system.

Figure 1:
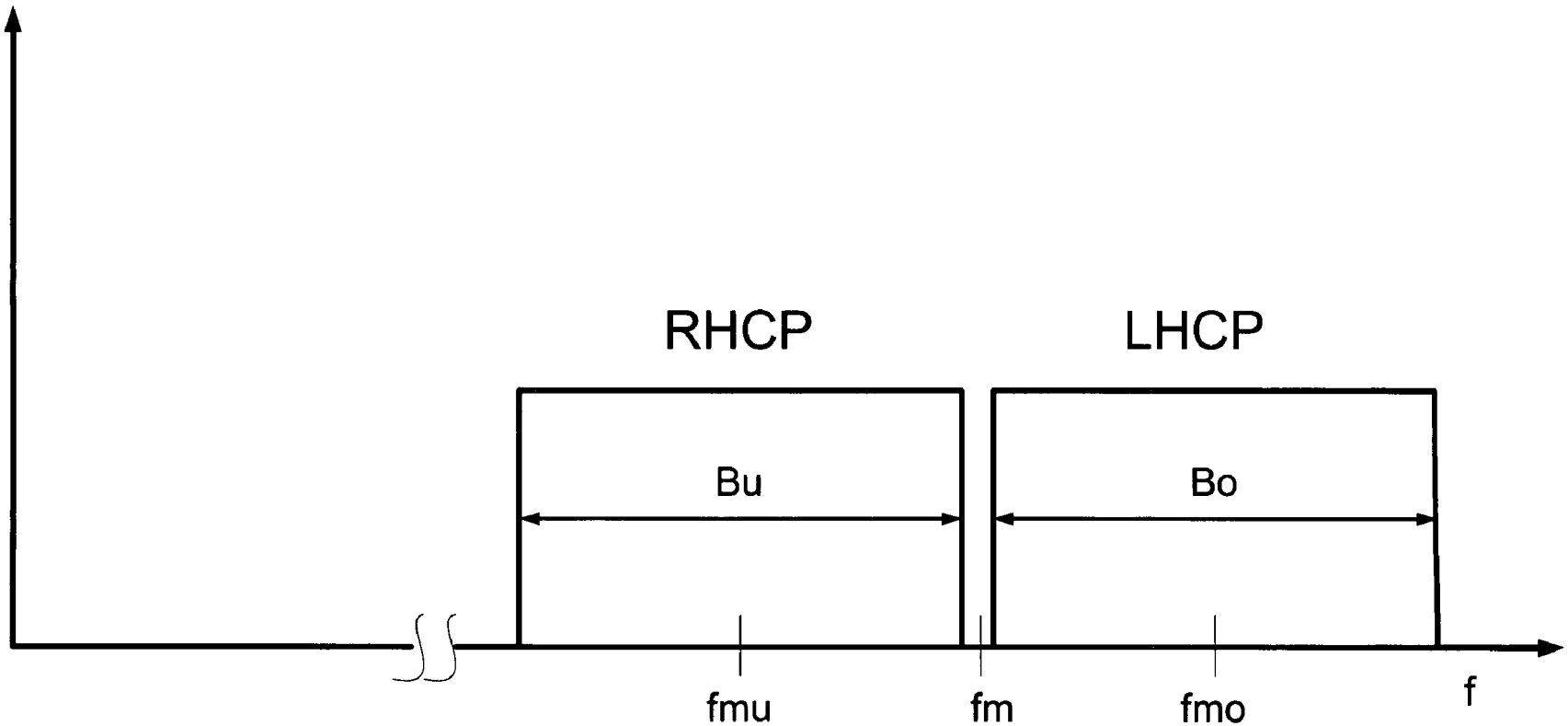
FIG. 1 is a graph of the frequency bands of two satellite radio signals having emissions circularly polarized in opposite directions of rotation, in close frequency proximity.

In FIG. 1, the set of problems from which the invention proceeds is shown. The set of problems results from the fact that two satellite radio frequency bands having a small bandwidth Bu and Bo, respectively, are emitted in immediate proximity, at a high frequency, in the L-band and in the S-band, respectively, in any case at a frequency of fm>1 GHz, with opposite directions, i.e. with right-rotating circular polarization (RHCP) and left-rotating circular polarization (LHCP), respectively. At a bandwidth Bu and Bo, respectively, of a few megahertz (typically about 4-25 MHz), the relative frequency distance between the center frequencies fmu and fmo is so slight that frequency-selective configuration of the antenna for left-rotating and right-rotating circular polarization is not possible at the same time.

In the following, the fundamentals for the configuration of antennas on which the antenna according to at least one embodiment of the invention is based will be explained.

Using FIG. 2, the relationship between electrically very short conductor elements, i.e. antenna conductor sections having a length Δ1 . . . Δ5<λ/20, through which current flows, and the complex field intensity vectors $\vec{E}$ and $\vec{H}$ generated at the remote reception point P will be explained. The electrically very short conductor elements are shown as vectors $\vec{\Delta}_1 \ldots \vec{\Delta}_5$, whose direction is determined both by the direction of the location in space and by the counting arrow direction of the current flowing on the conductor element, which can be seen as being constant, in terms of amount and phase. The coordinate directions of the spatial coordinate system are designated as x, y and z, its coordinate origin as B. In a general description of the $v^{th}$ conductor element with the complex current Iv and its position in space, described by the position vector $\vec{p}_v$, its contribution to the complex electrical field intensity vector $\vec{E}_v$ at the remote reception point P—spaced apart from the origin B of the coordinate system at the distance $r_A$—whose position is furthermore described by the unity directional vector $\vec{r}$, can be indicated. If N such conductor elements are present, then the electrical field intensity is summarily:

$$\vec{E}_v = j\exp(-j\beta r_A)\cdot\frac{Z_0}{2r\pi}\sum_{\upsilon=1}^{N}\{(\vec{\Delta}_v\times\vec{r})\times\vec{r}\}\cdot L_\upsilon\cdot\exp(j\cdot\beta\cdot\vec{p}_\upsilon+\psi_\upsilon) \quad \text{(Equation 1)}$$

Where: $I_v$ is the current amplitude and $\psi_v$ is the current phase of the $v^{th}$ conductor element; λ is the wavelength; β=2π/λ; $Z_0$ is the wave resistance of the free space.

If one combines the factors that have the same effect for all the conductor elements, into a constant $$c = j\cdot e^{-j\cdot\beta\cdot r_A}\cdot\frac{Z_0}{2r_A\lambda} \quad \text{(Equation 2)}$$

the time function of the electrical field intensity can be indicated as follows, in the case of an arbitrarily selected base phase:

$$\vec{E}_v = c\cdot\sum_{v=1}^{N} I_v\cdot\{(\vec{\Delta}_v\times\vec{r})\times\vec{r}\}\cdot\cos(wt+\beta\cdot\vec{p}_v\cdot\vec{r}+\psi_v) \quad \text{(Equation 3)}$$

Here, w is the circular frequency, and t is the time parameter.

In Equation (3), the term in the swung brackets stands for the spatial direction of the contribution of a conductor element to the spatial direction of the resulting electrical field intensity vector that is formed. If one describes the vector $\vec{\Delta}_v$ with its components $\Delta x_v$, $\Delta y_v$, $\Delta z_v$, the direction vector of the $v^{th}$ conductor element in the swung brackets can be indicated as follows:

$$\vec{RV}_v\begin{bmatrix}\Delta x_v\\ \Delta y_v\\ \Delta z_v\end{bmatrix}\times\begin{bmatrix}\sin\vartheta\cdot\cos\phi\\ \sin\vartheta\cdot\sin\phi\\ \cos\vartheta\end{bmatrix}\times\begin{bmatrix}\sin\vartheta\cdot\cos\phi\\ \sin\vartheta\cdot\sin\phi\\ \cos\vartheta\end{bmatrix} \quad \text{(Equation 4)}$$

Here,

θ is the elevation angle with reference to the vertical direction, and ϕ is the azimuthal angle.

Inserting this, one obtains a simplified equation in place of Equation (3):

$$\vec{E} = c\cdot\sum_{\upsilon=1}^{N} I_\upsilon\cdot\begin{bmatrix}RVx_v\\ RVy_v\\ RVz_v\end{bmatrix}\cdot\cos(wt+\beta\cdot\vec{p}_v\cdot\vec{r}+\psi_v) \quad \text{(Equation 5)}$$

From Equation (4), it is evident that different components $RVx_v$, $RVy_v$, $RVz_v$ result for the different conductor elements, which are oriented in any desired manner, and that these components contribute to the total field intensity with a different phase and amplitude. As a result, the direction of the total electrical field intensity vector $\vec{E}$ at the reception point P becomes time-dependent. The field intensity vector therefore oscillates over a period of the high-frequency vibration, in the general case not along a line, as would be necessary in order to accomplish the task according to the invention.

In the following, antennas according to the invention are presented, which accomplish the task according to the invention.

In the simplest form of the antenna, notional conductor elements having the same length can be disposed along an extended straight line and connected with one another in conductive manner, so that essentially, a rod-shaped conductor is formed, and an interruption of the rod-shaped conductor forms an antenna connection point. Straight-line conductors possess the property that all the conductor elements have the same direction vector, whose components in the x, y, and z direction stand in a relationship with one another that is common to all the conductor elements. Thus, the term in the swung brackets in Equation (5) can be drawn ahead of the sum formation, and in the sum term, all that remains is a superimposition of a number of vibrations that are the same in frequency, but different in amplitude and phase. For this, a resulting vibration is obtained, which with the following components of the E vector is shown in the equation below:

$$\vec{E} = c \cdot \begin{bmatrix} RVx_v \\ RVy_v \\ RVz_v \end{bmatrix} \sum_{\upsilon=1}^{N} I_\upsilon \cdot \cos(wt + \beta \cdot \vec{p}_v \cdot \vec{r} + \psi_v) \quad \text{(Equation 6)}$$

Therefore the vibration components of the electrical field intensity vector $\vec{E}$ possess the same phase in all spatial directions. The electrical field intensity vector is therefore polarized at every point in space and at every point in time along a fixed straight line specific to this point in space, the spatial direction of which line is given by the direction vector $\overrightarrow{RV}_v = \overrightarrow{RV}$.

Figure 3B:
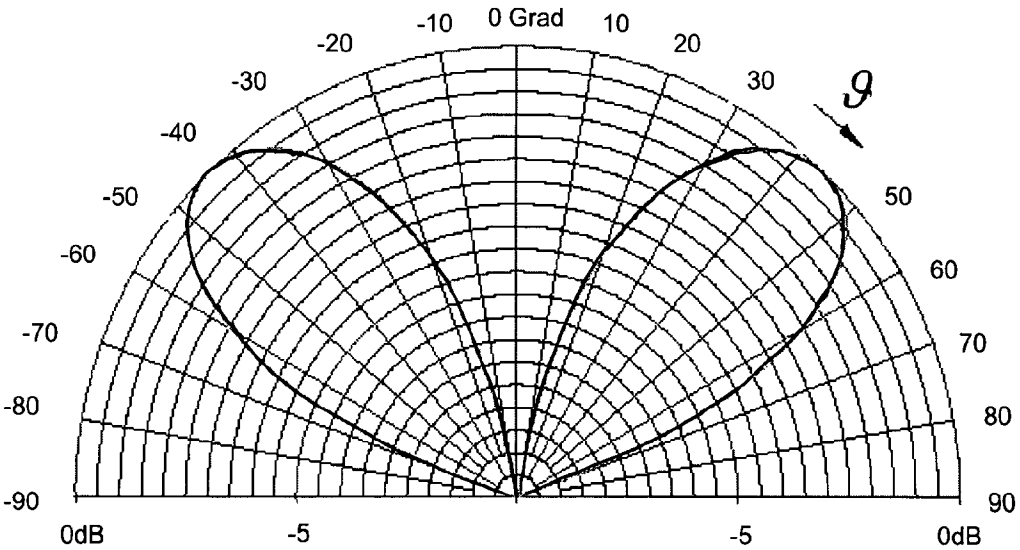
FIG. 3B is a vertical diagram for reception in the range of elevation angles between 25° and 65°.

For satellite radio reception in vehicles, in particular, antennas having an azimuthal omnidirectional characteristic are used, which are affixed to the electrically conductive outer skin of the vehicle. As will be explained below using FIGS. 3*a* and 3*b*, for this purpose an essentially rod-shaped conductor 4 can be affixed essentially perpendicular above an essentially horizontal, electrically conductive ground plane 6. The same spatial direction as for the antenna itself applies for the conductor elements, i.e. the antenna conductor section on the mirror image of the antenna formed in perpendicular manner above the conductive ground plane 6. This results in the omnidirectional emission property of the antenna that is desired for mobile reception. However, if the rod-shaped conductor 4 is inclined relative to the vertical line 2 on the ground plane 6, then it, together with its mirror image, forms a V-shaped antenna. Thus not all the conductor elements are oriented in the same direction, and the task according to the invention is not accomplished. It is therefore beneficial, according to one embodiment of the invention, that the deviation of the antenna from the vertical line on the ground plane 6 is as small as possible.

Figure 3A:
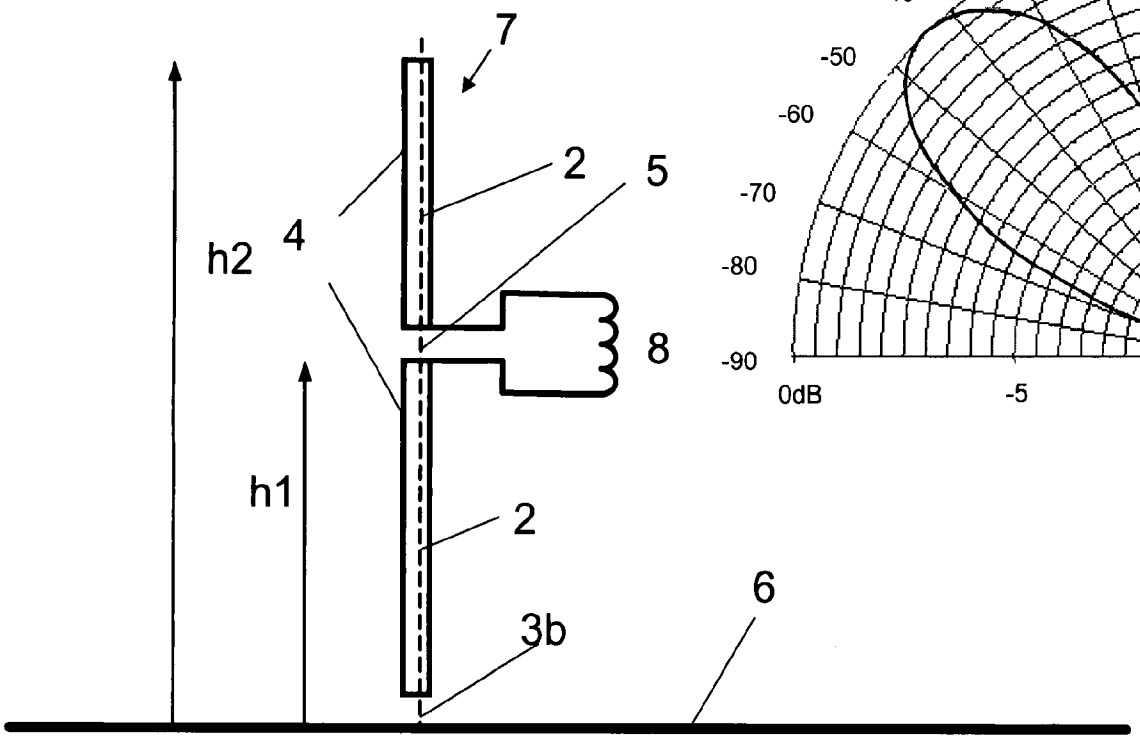
FIG. 3A is a diagram of a monopole that has an interruption point wired up with a reactive device, to configure its vertical diagram.

Particularly for the reception of geostationary satellites, whose signals arrive at a comparatively low elevation in northern latitudes, it is provided that the conductors 4, which form an essentially vertical monopole 7, contain at least one interruption point 5, which is wired up with, i.e. bridged with at least one reactive device 8, to configure the vertical diagram. In this manner, the vertical diagram can advantageously be adapted to the requirements. In FIG. 3A, an antenna connection point 3*b* is formed at the foot point of the monopole 7, and for configuration of optimal reception in the range of the elevation angle between 25° and 65°, as is evident in FIG. 3B, and the total length of the monopole 7 is configured about h2=⅝λ of the satellite signals to be received. For this purpose, the interruption point 5 is placed at the height of about h1=⅜λ to ⅝λ above the conductive ground plane 6, and this is wired up with an inductive resistor of approximately 200 Ohm, at the intended frequency $f_m$.

Figure 4:
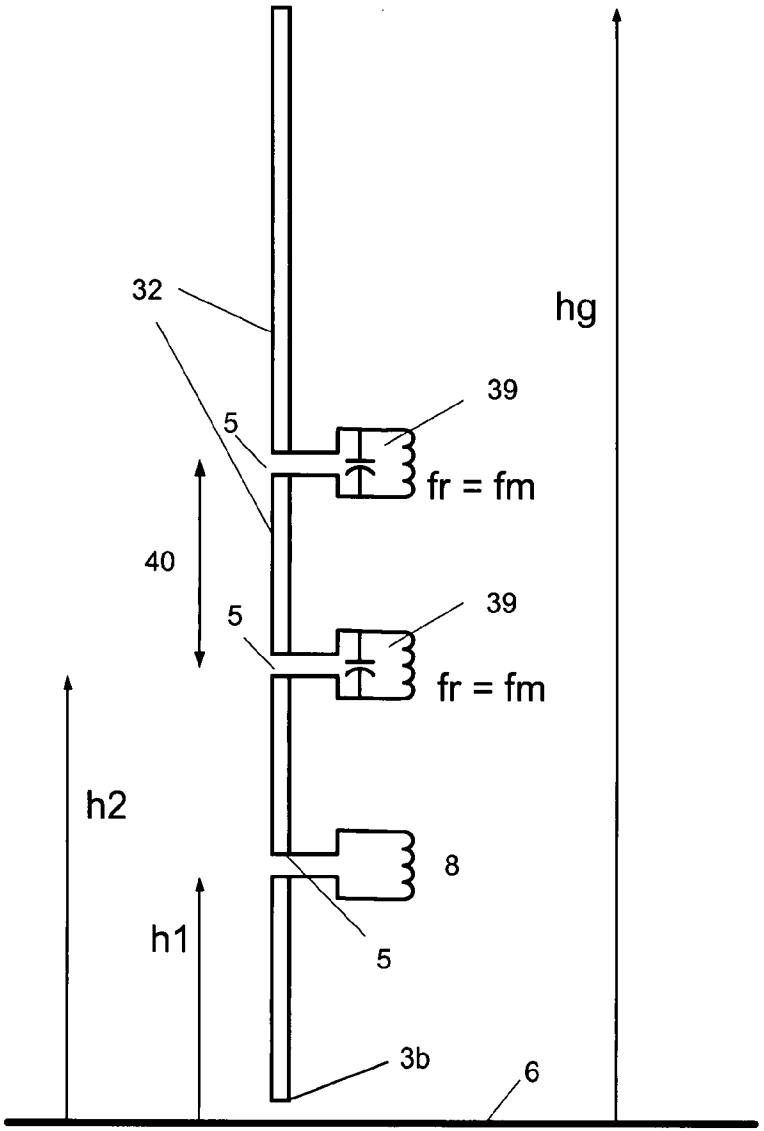
FIG. 4 is a satellite reception antenna for reception of satellite signals, combined with a longer antenna for reception of AM/FM radio signals.

Vehicle antennas are frequently configured as combination antennas for multiple radio services. Longer antennas are required, in particular, for reception of AM/FM radio signals. According to one embodiment of the invention, an antenna as in FIG. 3, having the height h2, can advantageously be extended to yield an AM/FM rod antenna having the total height hg, as shown in FIG. 4. In order to avoid the influence of the rod above the satellite reception antenna on the radiation characteristics of the latter, another interruption point 5 is provided at the upper end of the satellite reception antenna, which point is wired up with a high-ohm reactance, for example with a parallel resonance circuit 39, whose resonance frequency $f_r$ is coordinated with the center frequency $f_m$ of the satellite frequency bands. Another interruption point 5 is also wired up with a high-ohm reactance 39 at the distance 40, which is preferably smaller than ⅕λ, to further secure the radiation characteristics. The extension 32 of the rod antenna can already be freely configured, to a great extent, above the first parallel resonance circuit 39, and in particular, it can contain series elements that are at high ohms at the satellite frequency.

The principles explained above with regard to an antenna having a rod-shaped conductor, concerning the time independent of the spatial direction of the electrical field intensity vector, apply to all antennas, as will still be explained below on the basis of FIGS. 17 and 18, whose conductor elements, i.e. antenna conductor sections $\Delta_v$ are oriented parallel and thus possess the same common direction vector $\overrightarrow{RV}_v = \overrightarrow{RV}$. Equation (6) therefore also applies here, without any change. The conductor elements can therefore be disposed along multiple straight lines 2 that extend parallel to one another, so that multiple rod-shaped conductors are formed. In this connection, an interruption point for the antenna connection point 3*b* must be configured in at least one of the conductors. Others of these conductors can be used as parasitic radiators. This results in an advantageous variety of the configuration possibilities with regard to the radiation characteristics of the antenna. For mobile reception in vehicles, it is again advantageous and necessary, according to the invention, to orient the rod-shaped conductors vertically above an essentially horizontal conductive ground plane 6.

Figure 17:
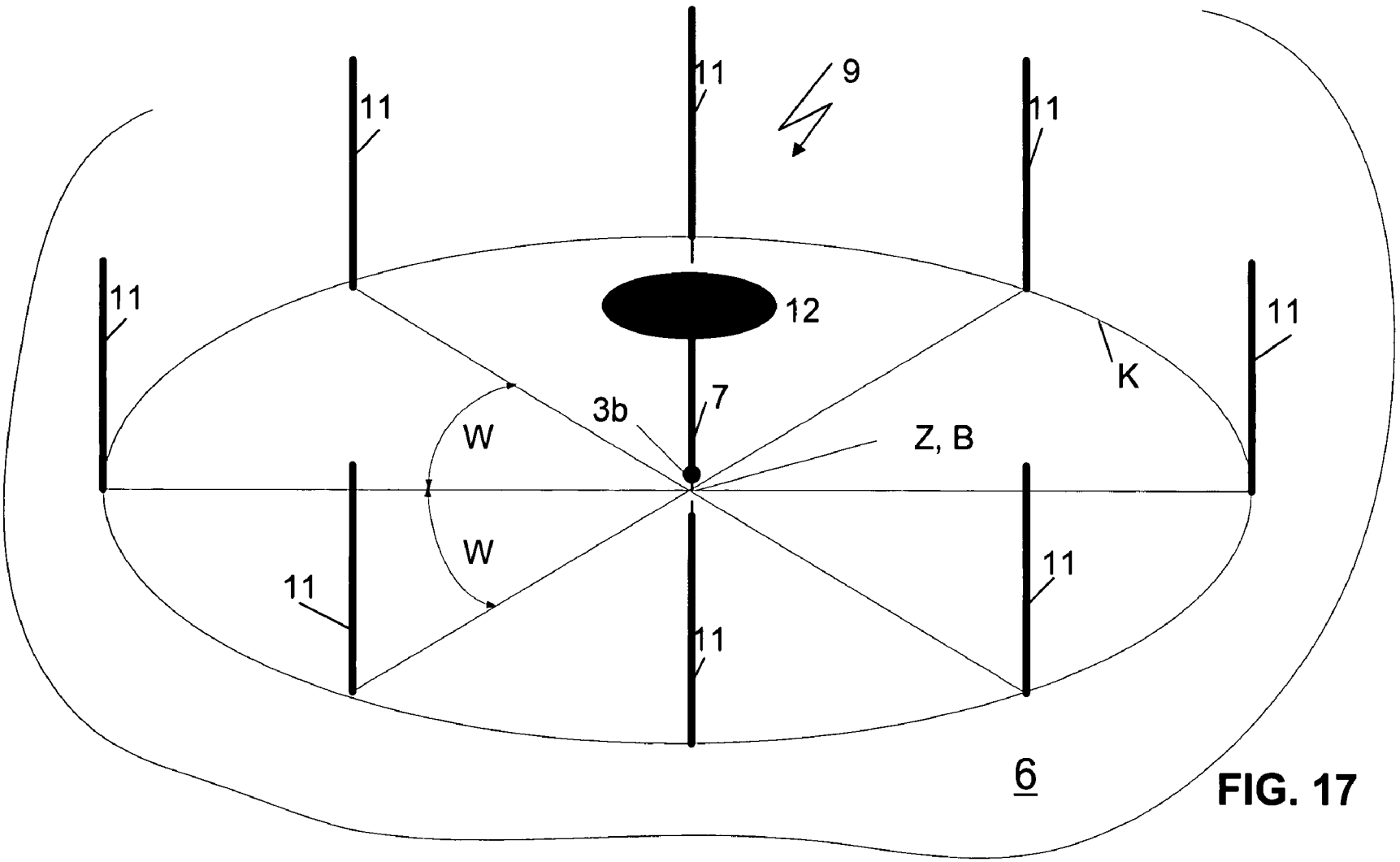
FIG. 17 is a schematic block diagram of a circular group antenna system 9 consisting of equal parasitic radiators 11 disposed on a circle K.

To configure an essentially omnidirectional azimuthal directional diagram of a circular group antenna system 9 according to the invention, as it is shown as an example in FIG. 17, with rod-shaped conductors having the same configuration, vertically disposed on the conductive ground plane 6, these conductors are advantageously configured as parasitic radiators 11, whereby a vertical antenna in the form of a monopole 7 having a roof capacitor 12 and the antenna connection point 3*b* is disposed in the center of the circular group antenna system 9. In order to satisfy the requirements for omnidirectionality of the azimuthal directional diagram, the number of parasitic radiators 11 of the same type that are disposed on a circle K at the same angular distance W is sufficiently large. The vertical directional diagram can be configured by means of the selection of the circle diameter, as well as the configuration of the parasitic radiators 11 and the centrally disposed antenna, by means of the selection of the height, as well as by means of the introduction of interruption points 5 wired up with reactive devices 8. In the case of vehicle antennas, in particular, there is frequently a demand for the lowest possible construction height. This can advantageously be achieved by means of affixing the roof capacitor 12.

Figure 18:
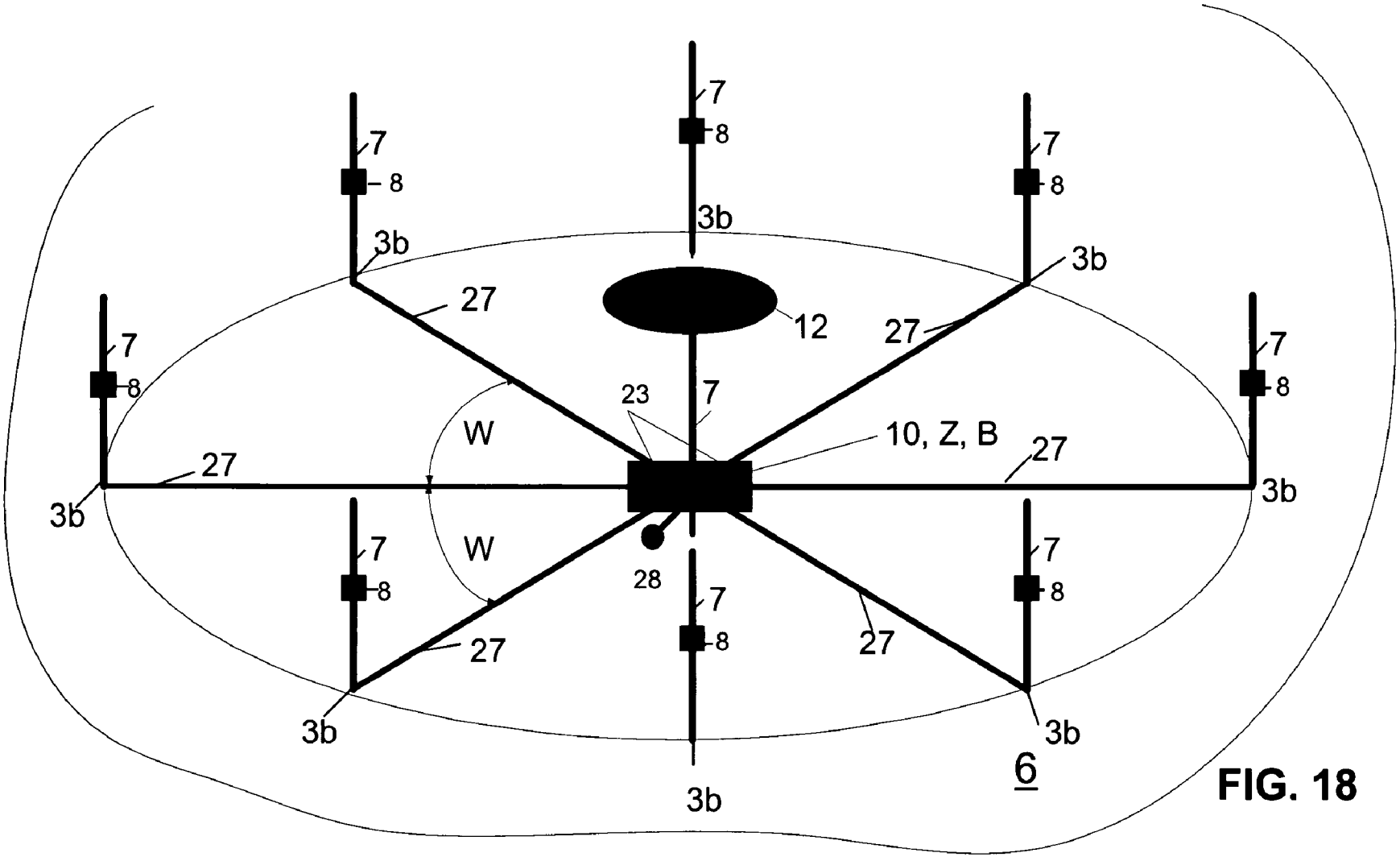
FIG. 18 is a schematic block diagram of a circular group antenna system 9 similar to FIG. 17, but with multiple monopoles 7.

In another advantageous embodiment of the invention, the rod-shaped conductors disposed in the circular group 9 in FIG. 18 form monopoles 7 that are coupled with an output connector 28 of the antenna. For this purpose, a distribution network 10 having multiple inputs 23 is provided, whose output 24 forms the output connector 28 of the antenna array. The rod-shaped connectors, having the same configuration and disposed in the circular group, comprise an antenna connection point 3*b*, in each instance, in other words form the monopoles 7 with monopole connection point, which are connected with one of the inputs 23 of the distribution network 10, in each instance, by way of an electrical line 27 of the same type. In the interests of the omnidirectionality of the azimuthal directional diagram, in reciprocal operation as a transmission antenna, the monopoles 7 are supplied with the same signals, according to amplitude and phase. The emitter, i.e. monopole 13 with roof capacitor 12, situated in the center B of the circular group antenna system 9, can advantageously be connected with one of the inputs 23 of the distribution network 10, and be supplied with a signal having a special amplitude and phase, in the reciprocal transmission case, to configure the vertical diagram, or, if necessary, can be configured as a parasitic emitter 11. Options such as the configuration of the height and the introduction of interruption points 5 wired up with reactive devices 8, as well as the configuration of roof capacitors 12, are also available here.

In contrast to the other antennas according to the invention presented previously, which are formed from a straight-line connector or multiple straight-line connectors that are parallel to one another, in the following more complex antenna structures will be considered.

Figure 2:
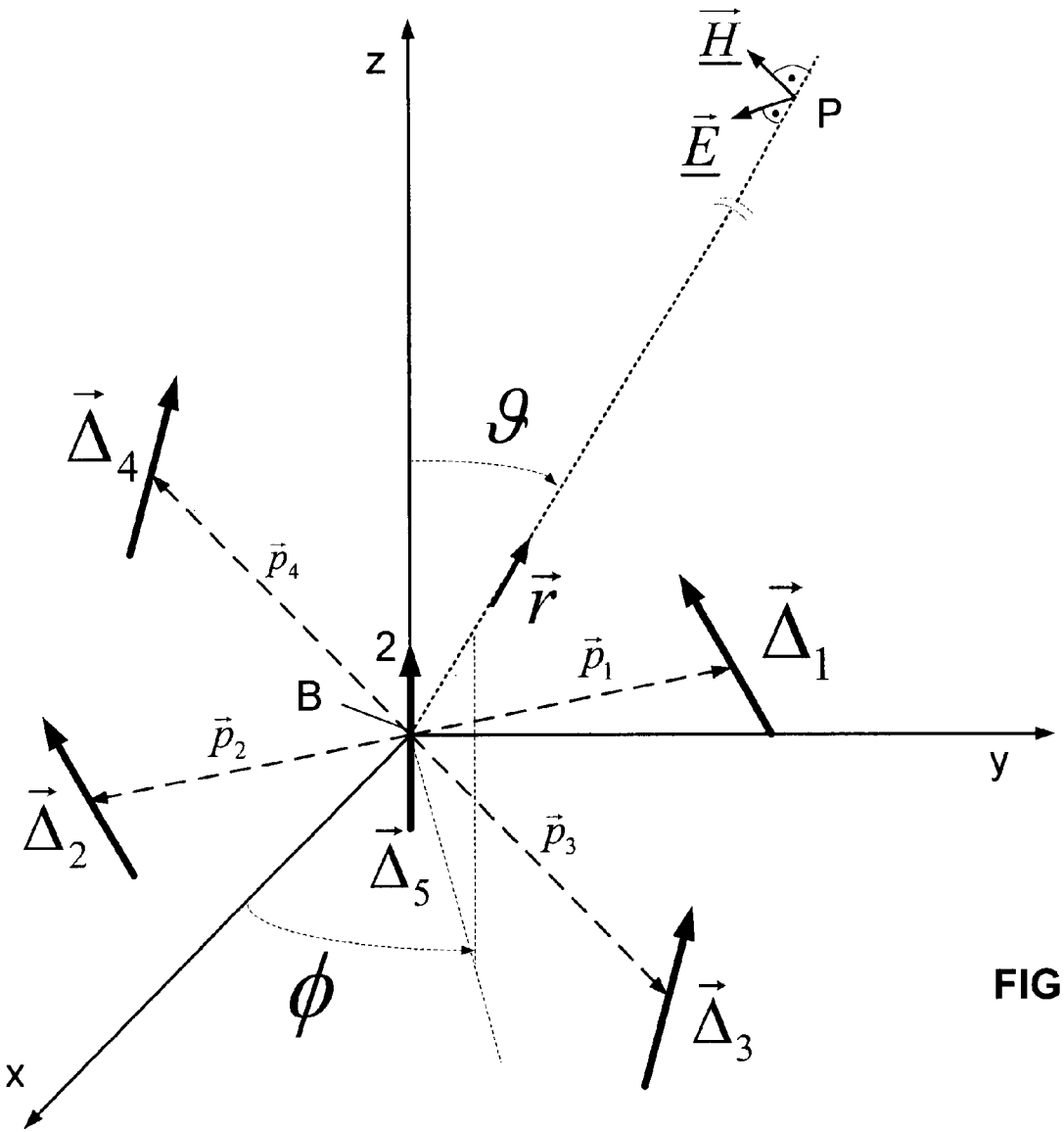
FIG. 2 is a graphical representation of the relationship between electrically very short conductor elements through which current flow, oriented in any desired manner, and the related electrical and magnetic field intensity vectors at a remote receiving point.

In order to explain the conditions required for this, in FIG. 2 the vectors $\vec{\Delta}_1$ and $\vec{\Delta}_2$ of the two very short conductor elements $\Delta_1=\Delta_2$, which have the same length, will be considered. These vectors are oriented parallel to one another and symmetrically positioned with reference to the origin B of the coordinate system, so that the two position vectors $\vec{p}_1$ and $\vec{p}_2$ are negatively of equal size relative to one another, i.e. $\vec{p}_1=-\vec{p}_2$ and also, the phase angles $\Psi_1$ and $\Psi_2$ are negatively of equal size, in other words $\Psi_1=-\Psi_2$. Because of the parallelity of the two conductor elements $\Delta_1$ and $\Delta_2$ it holds true that $\vec{\Delta}_1=\vec{\Delta}_2$. This also applies to the two equal direction vectors, in other words the following applies: $\overrightarrow{RV_{1\text{-}2}}=\overrightarrow{RV_1}=\overrightarrow{RV_2}$. The contribution $\vec{E}_{1\text{-}2}$ of the two conductor elements through which current flows to the electrical field intensity vector at the remote reception point P is therefore, according to Equation (5):

$$\vec{E}_{1-2}=c\cdot I_1\cdot\begin{bmatrix}RVx_1\\RVy_1\\RVz_1\end{bmatrix}\cdot[\cos(wt+\beta\cdot\vec{p}_1\cdot\vec{r}+\psi_1)+\cos(wt-\beta\cdot\vec{p}_1\cdot\vec{r}-\psi_1)] \quad \text{(Equation 7)}$$

From this, it follows directly that:

$$\vec{E}_{1-2}=c\cdot I_1\cdot\cos(\beta\cdot\vec{p}_1\cdot\vec{r}+\psi_1)\begin{bmatrix}RVx_1\\RVy_1\\RVz_1\end{bmatrix}\cdot\cos(wt) \quad \text{(Equation 8)}$$

From Equation (8), it is evident for the conductor elements $\Delta_1$ and $\Delta_2$ that the phase of the cosine vibrations in Equation (7), which is composed of the scalar product of the position vector $\vec{p}_1$ with the current phase $\psi_1$, is now exclusively contained in the amplitude factor $$c\cdot I_1\cdot\cos(\beta\cdot\vec{p}_1\cdot\vec{r}+\psi_1) \quad \text{(Equation 8a)}$$

both spatially and with regard to the current phases, as a result of the pair formation symmetrical to the origin of the coordinate system. In the case of an arbitrary assignment of the zero phase for the reference point—here, the origin of the coordinate system—the cosine vibration in Equation (8) is without phase shift. All the components of the electrical field intensity vector $\vec{E}_{1\text{-}2}$ possess the same phase, and one factor according to one embodiment of the invention, that of polarization, is met. If one sets up an analogous deliberation for the arbitrarily oriented pair of the conductor elements $\Delta_3=\Delta_4$ having the current amplitudes $I_3=I_4$ with the phase relationships of the current $\Psi_3=-\Psi_4$ as shown in FIG. 2, then the contribution to the electrical field intensity generated by this part of the conductor elements, by analogy to Equation (8), is as follows:

$$\vec{E}_{3-4}=c\cdot I_3\cdot\cos(\beta\cdot\vec{p}_3\cdot\vec{r}+\psi_3)\begin{bmatrix}RVx_v\\RVy_v\\RVz_v\end{bmatrix}\cdot\cos(wt) \quad \text{(Equation 9)}$$

By means of superimposition of the field intensity contribution generated by the two pairs of conductor elements, the following is obtained:

$$\vec{E}_{1-2}+\vec{E}_{3-4}=c\cdot\left\{1_1\cdot\cos(\beta\cdot\vec{p}_1\cdot\vec{r}+\psi_1)\begin{bmatrix}RVx_1\\RVy_1\\RVz_1\end{bmatrix}+I_3\cdot\cos(\beta\cdot\vec{p}_3\cdot\vec{r}+\psi_3)\begin{bmatrix}RVx_3\\RVy_3\\RVz_3\end{bmatrix}\right\}\cdot\cos(wt) \quad \text{(Equation 10)}$$

The two direction vectors $\overrightarrow{RA}_1$ and $\overrightarrow{RV}_3$ of the pairs of conductor element, oriented in space in any desired manner, in each instance, are therefore weighted and added up with a factor that contains the current amplitude, the position vector $\vec{p}$, as well as the current phase $\Psi$. With the sum vector $\overrightarrow{SV}$ that results from this:

$$\overrightarrow{SV}=\left\{I_1\cdot\cos(\beta\cdot\vec{p}_1\cdot\vec{r}+\psi_1)\begin{bmatrix}RVx_1\\RVy_1\\RVz_1\end{bmatrix}+I_3\cdot\cos(\beta\cdot\vec{p}_3\cdot\vec{r}+\psi_3)\begin{bmatrix}RVx_3\\RVy_3\\RVz_3\end{bmatrix}\right\}=\begin{bmatrix}SVx\\SVy\\SVz\end{bmatrix}$$

we obtain, in place of Equation (10)

$$\vec{E}_{1-2}+\vec{E}_{3-4}=c\cdot\begin{bmatrix}SVx\\SVy\\SVz\end{bmatrix}\cdot\cos(wt) \quad \text{(Equation 11)}$$

The direction of the sum vector $\overrightarrow{SV}$ therefore results not only from the directions of the two direction vectors of the pairs of conductor elements $\Delta_1$, $\Delta_2$, but also from their complex currents, and is determined from the ratio of the components SVx, SVy, SVz of the sum vector $\overrightarrow{SV}$. Each of these components changes over the period of the cosine vibration, with the same phase, so that the polarization of the electrical field intensity vectors takes place strictly along a line at every point in time, according to one embodiment of the invention. Of course, while this line is always oriented perpendicular to the unity direction vector $\vec{r}$, it can assume any desired direction otherwise. A component of the electrical field intensity perpendicular to this line does not exist at any point in time. This deliberation can be expanded to cover the superimposition of any desired number of pairs of conductor elements $\Delta_v$ of this type, oriented in space in any desired manner, without changing the previous statements. For a more general representation, a common reference phase $\Psi_0$ for the current phases of all the conductor elements will now be introduced, and it will be required that it holds true for the current phases of the conductor elements assigned to one another in pairs—e.g. $\Psi_1$ and $\Psi 2$—that they deviate from this reference phase by the same value $\Delta\Psi_{12}$ but with different signs, in other words:

$\Psi_1=\Psi_0+\Delta\Psi_{12}$ and $\Psi_2=\Psi_0-\Delta\Psi_{12}$, so that the following holds true: $(\Psi_1+\Psi_2)/2=\Psi_0$ If this relationship applies for all the pairs of conductor elements, such as, for example, the pair of conductor elements $\Delta_3$ and $\Delta_4$, then it holds true analogously that: $\Psi_3=\Psi_0+\Delta\Psi_{34}$ and $\Psi_4=\Psi_0-\Delta\Psi_{34}$, so that it holds true that: $(\Psi_3+\Psi_4)/2=\Psi_0$, etc.

Subject to this condition, the field contributions of all the conductor element pairs in Equation (11) possess the same base phase $\Psi_0$. Of course, the selection of the base phase of the time function $\Psi_0$ does not have any influence on the sum vector $\overrightarrow{SV}$.

Thus, it can be summarized that an antenna that consists of a plurality of electrically very short conductor elements $\Delta_1$, $\Delta_2$ or $\Delta_3$, $\Delta_4$, etc., as shown in FIG. 2, disposed in pairs, symmetrical to a common reference point B in space, in the manner indicated, and having the same orientation, achieves the result that—brought about by the excitation of the antenna at the antenna connection point 3—these elements act in pairs as emitting elementary antennas $\Delta_n$, $\Delta_m$, and the current that flows in the two elementary antennas that belong to an elementary antenna pair, e.g. $\Delta_1$, $\Delta_2$ in FIG. 2, is the same in terms of size, and that the spatial reference point for all the elementary antenna pairs $\Delta_n$, $\Delta_m$ forms a common phase center B, in such a manner that the arithmetical average of the phases of the two currents, counted in the same direction, in each instance, of an elementary antenna pair possesses the same value ($\Psi 0$) for all the dipole pairs $\Delta_n$, $\Delta_m$ . . . .

Electrically short antennas, in other words antennas whose dimensions amount to $<\frac{3}{8}\lambda$, have the property that the currents on these antennas have practically constant phases over their expanse. Thus, as will be explained below using FIG. 5*a* and FIG. 5*b*, for example, a loop antenna 14—having an antenna connection point 3*a* configured by means of interruption of the loop 14—will be formed by means of conductive serial joining of electrically very short conductor elements, i.e. antenna conductor sections about a common reference point.

Figure 5B:
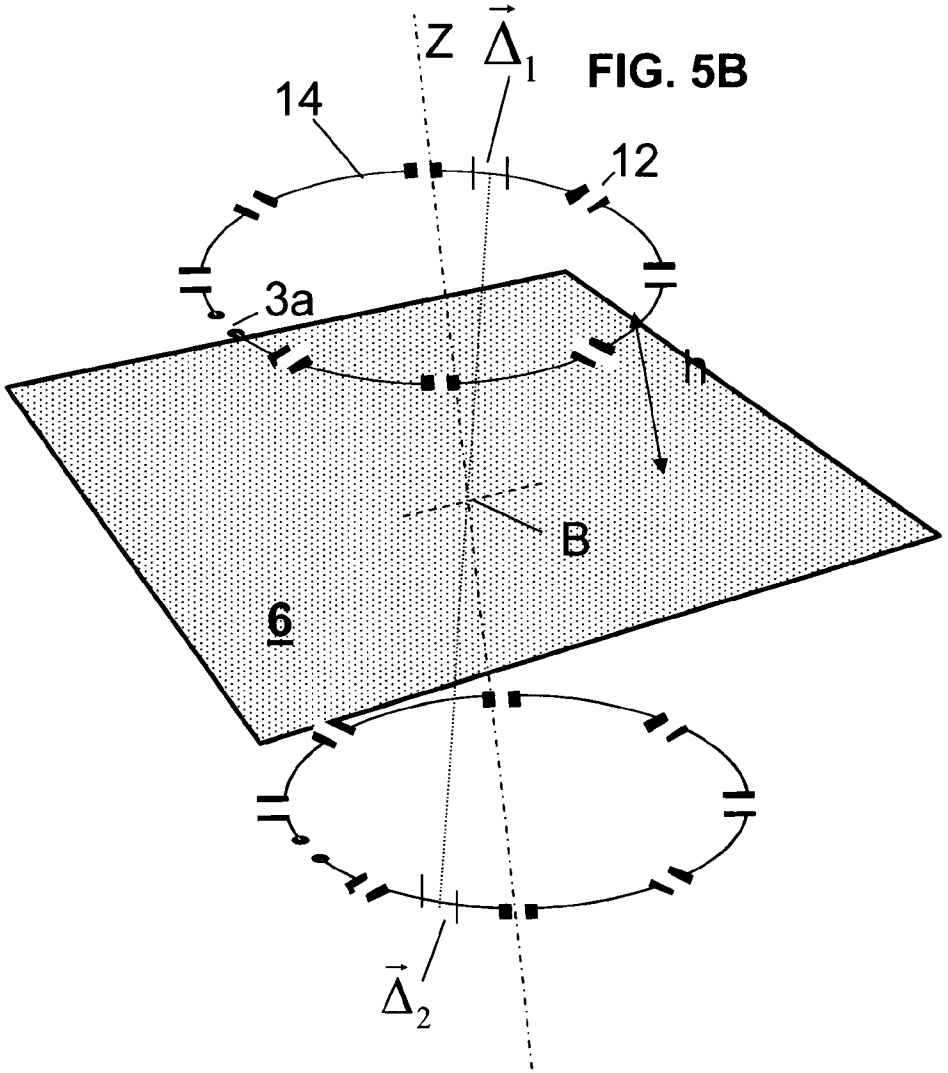
FIG. 5B is a circular loop antenna at a constant height h above a conductive ground plane with a notional mirror image.

For example. FIG. 5B is a circular loop antenna at a constant height h above a conductive ground plane 6 with a notional mirror image, If the dimensions of the loop 14 are sufficiently small electrically, so that the ring current is the same at all points, in terms of amount, there is a corresponding very short conductor element $\Delta_m$ for every very short conductor element $\Delta_n$, forming a pair, so that the conditions stated above apply to the loop 14. Such a loop 14 can be configured as a regular n-gon, for example, having the phase reference point B at the point of symmetry of the n-gon. In another example, the loop antenna 14 is formed from multiple closed loops having a common phase reference point, but the antenna connection point 3*a* is formed in one of the loops, by means of interruption. In another advantageous embodiment, the loop antenna 14 consists of multiple loops, conductively joined in series, which are essentially disposed in planes that are parallel to one another, with the slightest possible distance from one another, in the form of a coil or spiral. In this connection, an essentially common central phase reference point is formed for all the loops, and the antenna connection point 3*a* is provided by the two ends of the coil.

Figure 5A:
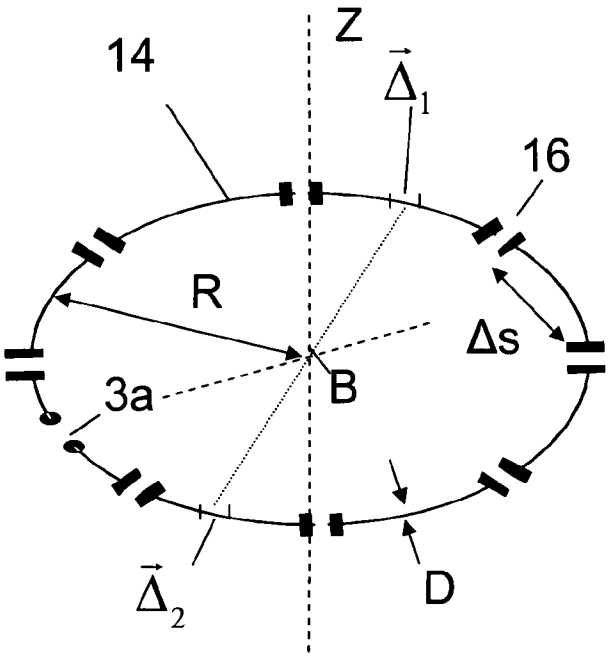
FIG. 5A is a circular loop antenna according to the invention, with capacitors.

In a particularly advantageous embodiment of the invention, as it is shown in FIGS. 5*a* and 5*b*, for example, the loop antenna 14 is not electrically short, and contains multiple capacitors or condensers introduced at interruption points 5, for effective electrical shortening. In this way, the constancy of the current on the conductor elements, in terms of amount and phase, is sufficiently assured.

FIG. 5A is a circular loop antenna according to the invention, with capacitors 16, For example, FIG. 5A shows a circular loop antenna 14 having the radius R, which can also be structured as a polygon. The phase center B is situated at its center point. The structure is divided up into "z" line sections, each having the length $\Delta s$. The overall circumferential length amounts to S. The antenna acts as a frame antenna having dimensions in the range of the wavelength, whereby nevertheless, according to the invention, a homogeneous current distribution is achieved by means of subdivision of the structure and insertion of capacitors 16. As a result, the antenna acts electrically shortened in length, and generates a homogeneous, horizontally polarized electromagnetic field in all directions. In contrast to the one-dimensional structures described above, the ring line is two-dimensional. According to the invention, a corresponding very short conductor element having the same orientation is present for every one of the electrically very short conductor elements $\Delta_1$, $\Delta_2$, . . . , which act as elementary antennas, and current flows through this element in the opposite direction, so that the pair formation described above exists with reference to the phase center B in the center. In FIG. 5A, two paired electrically very short conductor elements are shown as examples, as vectors $\vec{\Delta}_1$, $\vec{\Delta}_2$, whose direction is determined both by the direction of their location in space, and by the counting arrow direction of the current that flows on the conductor element, which current can be viewed as constant in terms of amount and phase.

In FIG. 5B, the loop antenna 14 is disposed at a constant height h above the conductive ground plane 6. Because of the mirror effect at the ground plane 6, the common phase center B now lies on the ground plane 6. Again, two paired electrically very short conductor elements, indicated as vectors $\vec{\Delta}_1$, $\vec{\Delta}_2$, are shown, as examples; their direction is determined both by the direction of their position in space and by the counting arrow direction of the current that flows on the conductor element, which current can be viewed as constant in terms of amount and phase. Thus, a corresponding paired conductor element exists for every conductor element of the loop antenna 14, on the virtual mirror image of the loop antenna 14, so that this antenna array also accomplishes the task according to the invention. The vertical main radiation direction can be adjusted by way of the selection of the height h and the radius of the line ring. A zero point can be achieved in the vertical direction and in the horizontal direction.

Figure 5C:
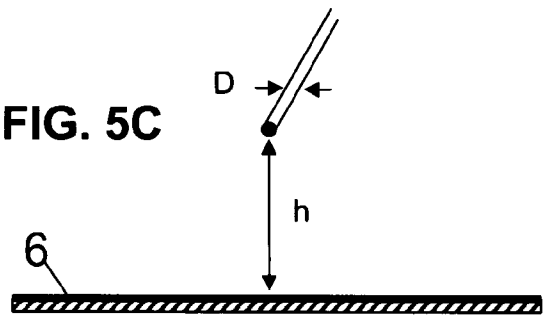
FIG. 5C is a detail of the loop antenna to explain the calculation of the wave resistance Zw of the circumferential line above the conductive ground plane.

According to the invention, the ring-shaped circumferential conductor length S again is divided into z pieces of the same length, having the length $\Delta s=S/z$. Let the conductor wave resistance of the circumferential line according to the representation in FIG. 5C above the conductive ground plane 6 be Zw. FIG. 5C is a detail of the loop antenna to explain the calculation of the wave resistance Zw of the circumferential line above the conductive ground plane. The capacitative reactance ΔX per line piece Δs and thus the capacitance value C=1/(φ*ΔX) to be inserted into this conductor piece, in each instance, is defined, when assuming an extended length Δs and with an approximately ring-shaped line having a large radius R of the ring-shaped loop antenna 14, relative to the conductor height h, by $$\Delta X/Zw=\tan(2\pi\Delta s/\lambda).$$

In a good approximation, the following is obtained for the capacitance value C to be inserted into the line piece Δs:

$$C=1/(\omega\cdot Zw\tan(2\pi\Delta s/\lambda))$$

circular frequency of the satellite signals=ω; free space wavelength of the satellite signals=λ

In order to obtain an omnidirectional diagram with a good approximation, the line having the length S must be divided into sufficiently many partial pieces by means of the insertion of capacitances 16. The following holds true for a useful division: Δs/λ<⅛. If the partial pieces Δs=S/z are selected to be sufficiently small, the uniformity Δs of all the partial pieces is not absolutely necessary, as long as a capacitance 16 whose value is calculated according to the criterion described above, from the relative length Δs/λ of the partial piece in question, is only inserted after every partial piece.

As an example for the configuration of the reception in the range of an elevation angle between 25° and 65°, in the case of an azimuthal omnidirectional characteristic, a horizontally disposed loop antenna 14 is placed at a distance of about 1/16 of the wavelength above the conductive ground plane 6, as is shown as an example in FIG. 5B. The diameter of the loop antenna 14 is selected to be slightly greater than ¼ of the wavelength. An interruption point 5 wired up with a capacitor 16 having a reactance of about −200 ohms is inserted along the line, in each instance, at intervals of about ⅛ of the wavelength.

Figure 7A:
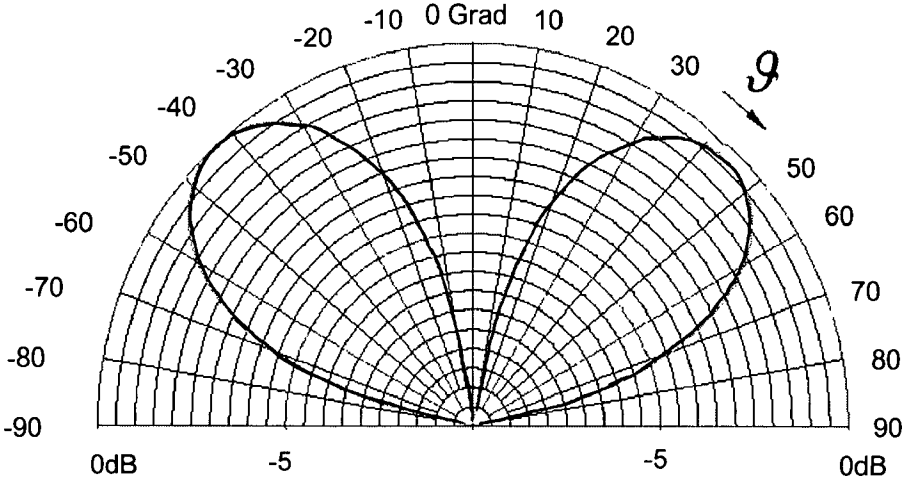
FIG. 7A is a vertical diagram of a loop antenna according to FIG. 5B and FIG. 6 for a left-rotation circular polarization.
Figure 7B:
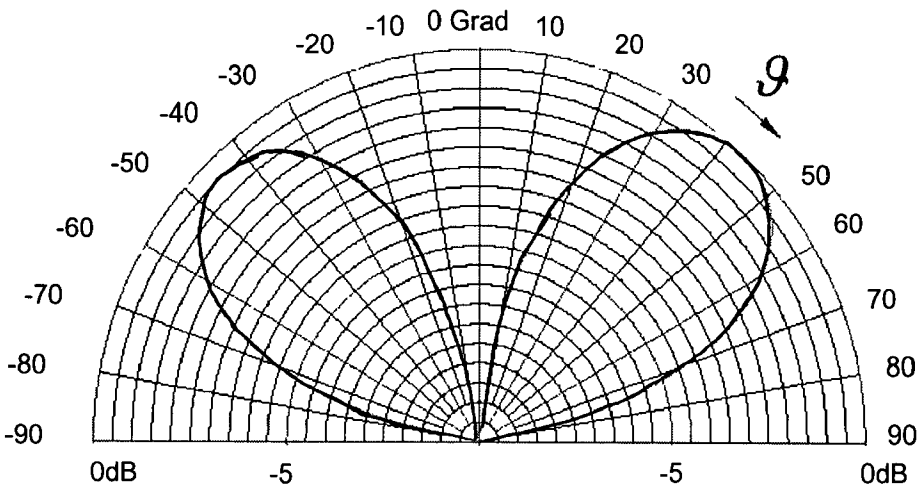
FIG. 7B is a vertical diagram of a loop antenna according to FIG. 5B and FIG. 6 for a right-rotating circular polarization.

FIG. 7 shows the vertical diagram of such an antenna for a) left-rotating circular polarization and b) right-rotating circular polarization, as an example. A possible slight residual non-symmetry can be reduced by means of refining the circuit with reactances, according to the above information, and improving the symmetry of the antenna with regard to the antenna connection point 3*a*,3*b*. For the example of a ring-shaped loop antenna 14 in the frequency range around 1500 MHz, a radius R of about 4 cm, a height h of about 18 mm, and a conductor diameter D of about 3 mm have proven to be advantageous for implementing both the vertical directional diagram and a suitable conductor wave resistance Zw.

Figure 6:
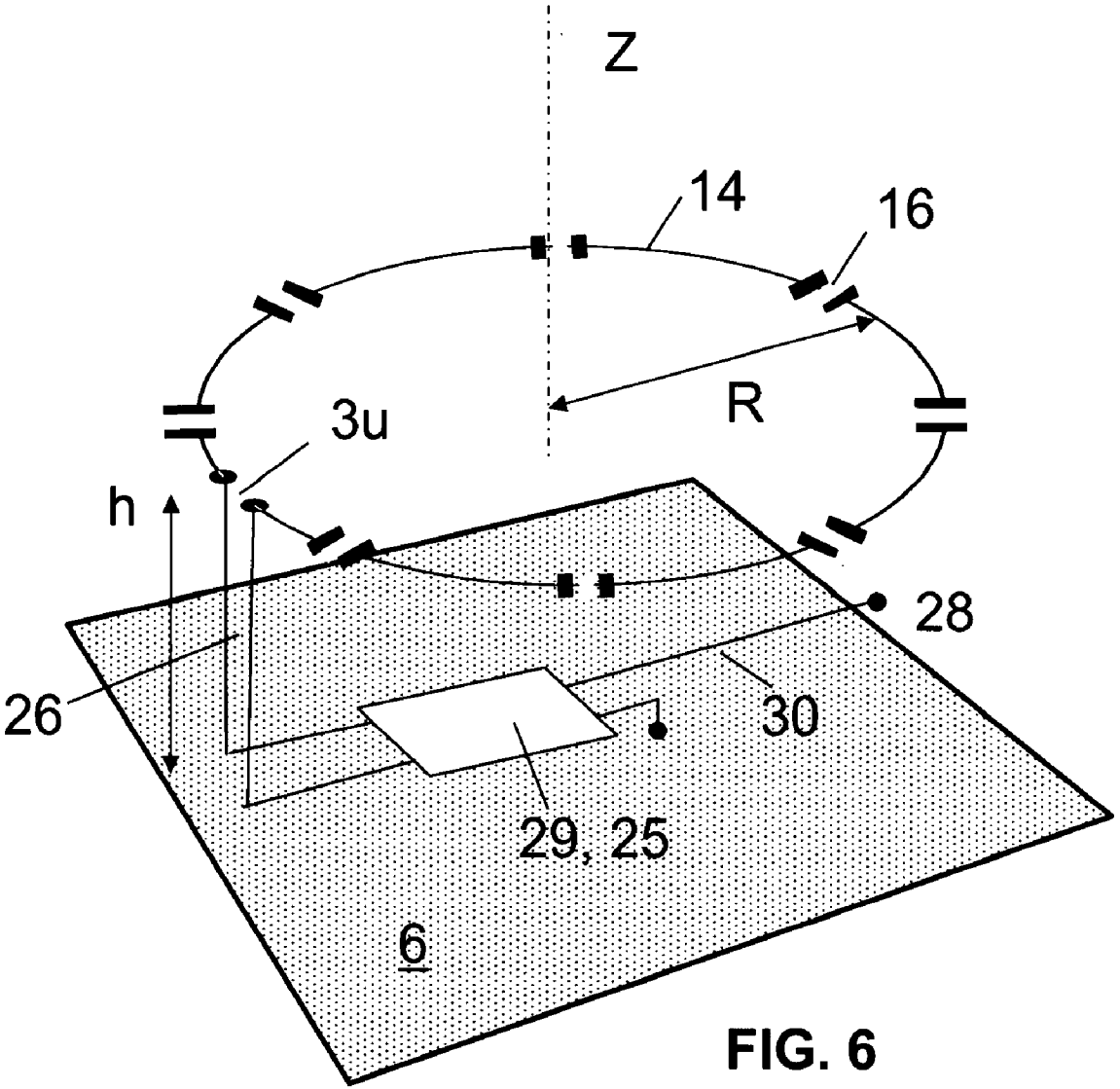
FIG. 6 is a variant of the loop antenna in FIG. 5*b* with uncoupling of the reception signals by way of a symmetrical two-wire line outside of its center Z, and with a balun and an adaptation network.

FIG. 6 shows another advantageous embodiment of a loop antenna 14 according to the invention, with uncoupling 18 at the antenna connection point 3*a*, 3*b*, by way of a two-wire line 26 outside of the center Z, a balun 29, and an adaptation network 25. For example, FIG. 6 is a variant of the loop antenna in FIG. 5*b*. The influence of the symmetrical vertical feed line in the form of the two-wire line 26, which is not situated in the phase center, does not reduce the polarization purity because of the symmetry properties described below. It is advantageous if the connection of the one connector on the non-symmetrical side of the balun 29 to the connection point 28 of the antenna array takes place using a microstrip conductor 30 passed over the conductive ground plane 6. The other connector on the non-symmetrical side of the balun 29 is connected with the electrically conductive ground plane 6. Because of the symmetry properties of the two-wire line 26, the effects of the currents that flow in opposite directions on the conductors of the two-wire line 26 compensate one another, so that these also do not influence the radiation properties of the loop antenna 14. As will be explained below, the currents generated on these lines by the electromagnetic reception field also do not have any influence on the effects at the antenna connection point 3*a*, 3*b*.

Figure 16:
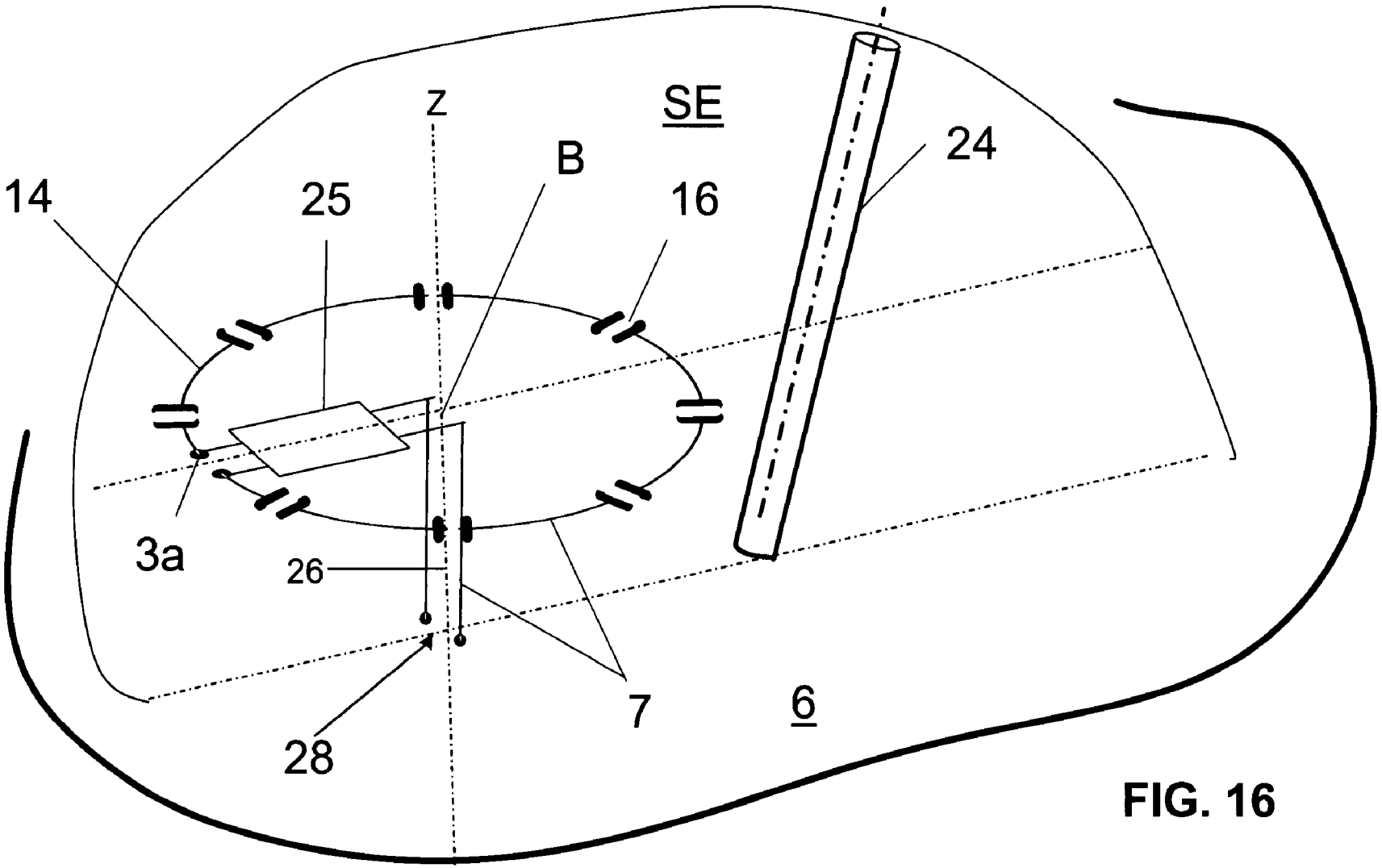
FIG. 16 is a schematic block diagram of an antenna array similar to the examples in FIGS. 8 to 15.

An electrical conductor that is guided in a plane of symmetry SE of the satellite antenna array, which plane is oriented perpendicular to the ground plane 6 and symmetrically with reference to the antenna connection point 3*b*, for example as an antenna having a planar configuration or as a linear antenna 24—as in FIG. 16—is without influence on the method of effect of the satellite antenna, because of the symmetry relative to the antenna connection point 3*b*. The effect of the currents brought about by the electromagnetic reception field in the antenna 24 cancel one another out with regard to their effect at the antenna connection point 3*b*. This also applies to the two electrical conductors of the two-wire line 26 in FIG. 6, which can be viewed as being guided in the plane of symmetry SE, because of the slight distance of the two conductors from one another. Advantage is taken of this property, which uncouples the antenna 24 in FIG. 16 and the antenna connection point 3, in an advantageous embodiment of the invention, when configuring combination antennas for different radio services. Such an antenna can therefore be used for radio services such as AM/FM reception, cell phone services, etc., in addition to satellite reception, by means of disposing one or more antennas that are separate from one another and guided in the plane of symmetry SE, such as the antenna 24, for example.

Figure 8:
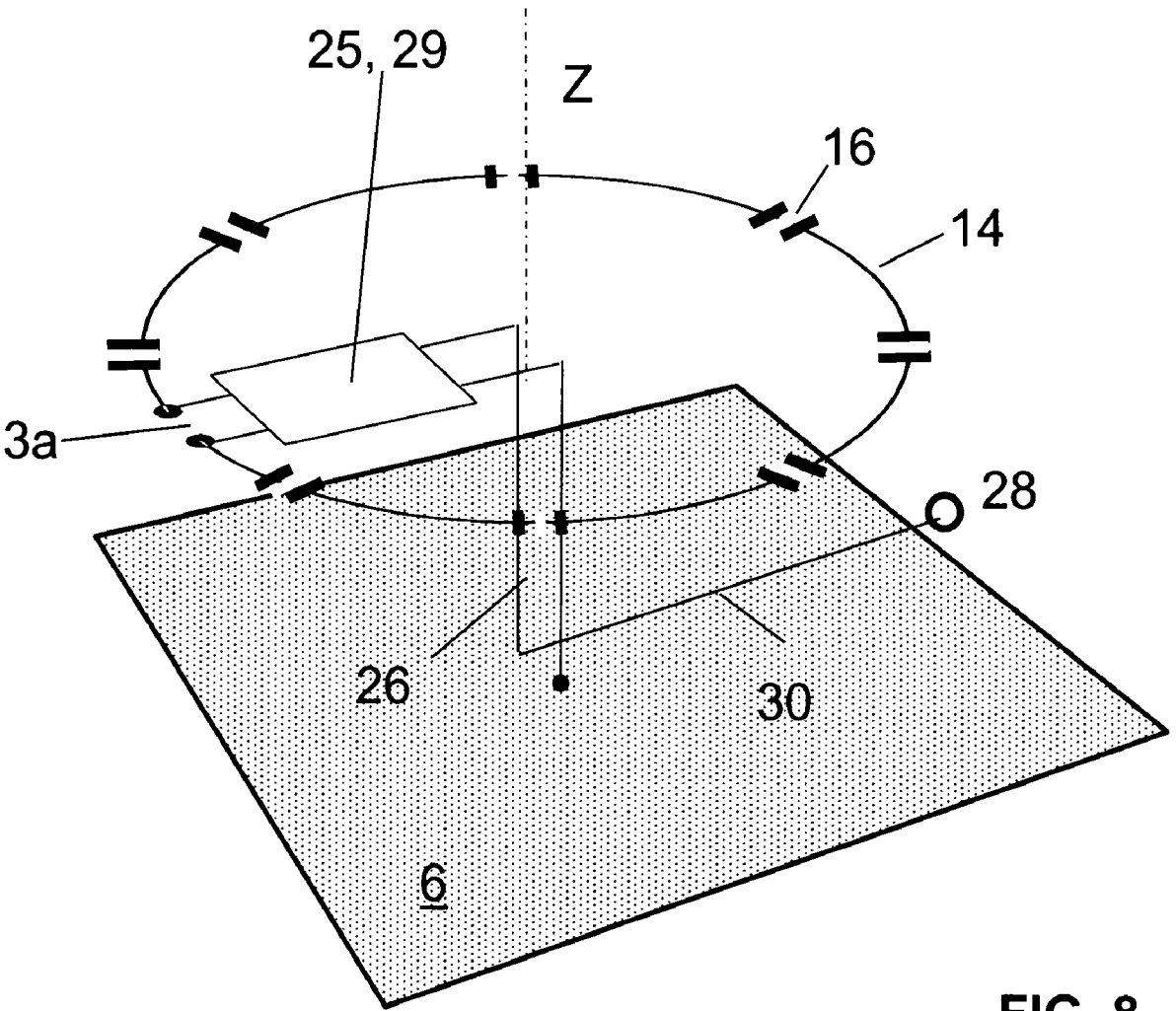
FIG. 8 is another embodiment of the loop antenna.

In the case of the advantageous embodiment of the loop antenna 14 shown in FIG. 8, the uncoupling takes place centrally and on the ring plane. The adaptation network 25 and the balun 29 are also disposed on the ring plane. The two-wire line 26 is connected on the non-symmetrical side of the balun 29, and guided to the ground plane 6 in the center Z. There, its first conductor is connected with the conductive ground plane 6, and its second conductor is connected with the microstrip conductor 30 guided over the base plate 6. The latter conductor produces the connection to the connection point 28 of the antenna array. Here again, the effects of the currents that flow in opposite directions on the conductors of the two-wire line 26 compensate one another, so that these do not influence the radiation properties of the loop antenna 14.

Figure 9:
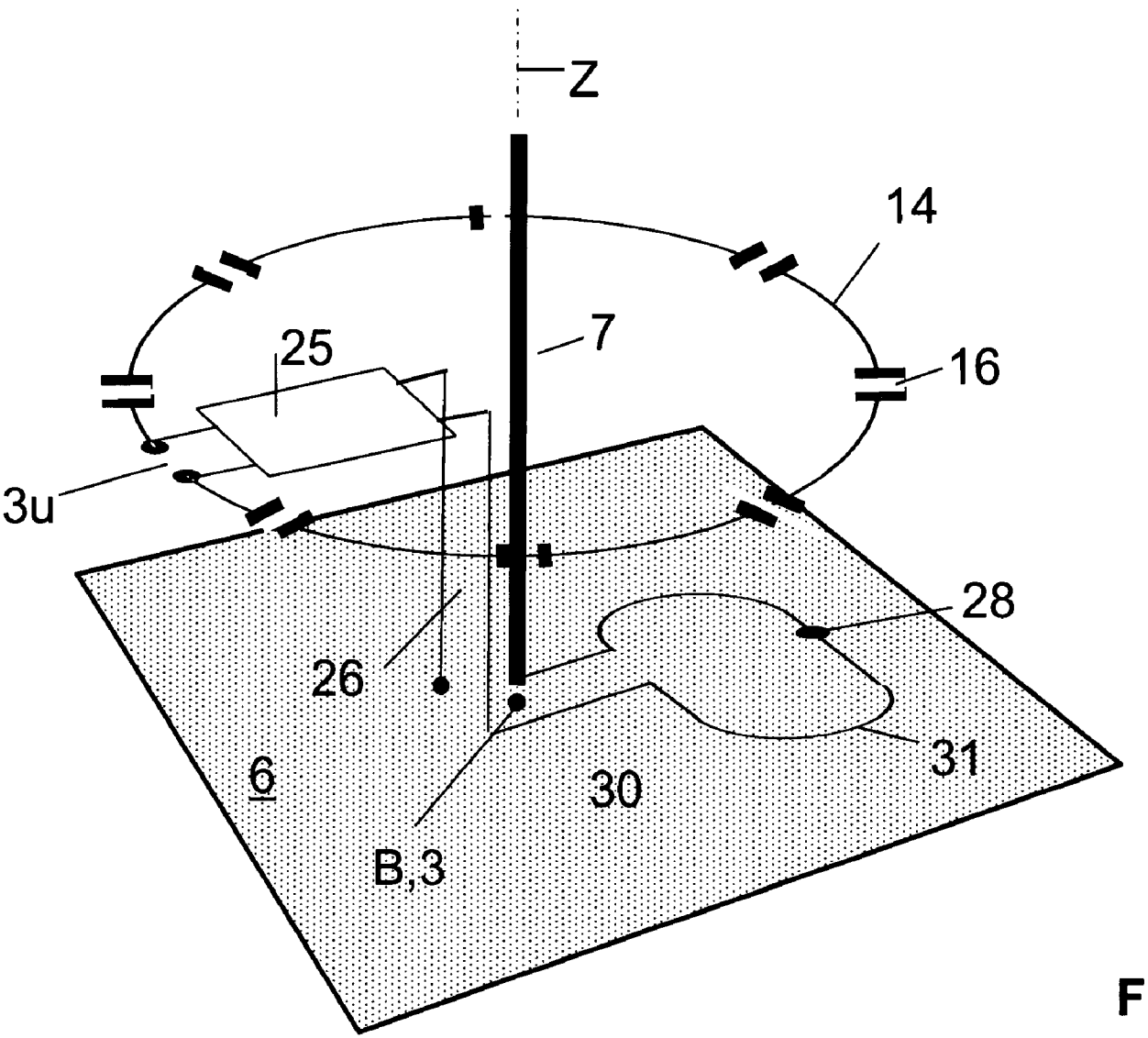
FIG. 9 is another embodiment of the loop antenna, with a monopole configured as a rod antenna, for reception of vertically polarized fields in the center Z of the horizontal loop antenna.

For the case that the satellite radio system is additionally supported by means of the transmission of vertically polarized terrestrial signals in another frequency band having the same bandwidth, closely adjacent in frequency, in certain areas, it is desirable to fill up the vertical directional diagram for these signals in the direction towards low elevation angles. As a result, the antenna can receive both the satellite reception signals and the terrestrial signals, in a compromise. In order to achieve this, FIG. 9 is another embodiment of the loop antenna, with a monopole configured as a rod antenna, for reception of vertically polarized fields in the center Z of the horizontal loop antenna; with a power splitter and phase-shift network for phase-correct superimposition of the horizontally and vertically polarized field components;

This embodiment includes an electrically short, vertically oriented monopole 7 is affixed at the central phase reference point B of the loop antenna 14 in FIG. 9. Furthermore, a power-coupling and phase-shift network 31 is provided as a distribution and/or coupling network, which acts as a power distributor in the reciprocal transmission case, to which the loop antenna 14, on the one hand, and the monopole 7, on the other hand, are connected by way of separate connectors, and which is configured in such a manner that in the reciprocal transmission case, the phases of the currents that flow in the monopole 7 and in the loop antenna 14 are the same, in each instance. Because of the same-phase condition of the currents on the loop antenna 14 and the monopole antenna 7 with regard to the phase center B on the ground plane 6, taking the mirror effect into consideration, the conditions required above for the formation of pairs of conductor elements $\Delta_n$, $\Delta_m$ and therefore for polarization of the electrical field intensity are met. In this connection, the main radiation direction in the vertical diagram of the loop antenna 14 is drawn towards a lower elevation by means of adding the vertical monopole 7. The combination now allows reception of a vertically polarized electrical field also at lower elevation, for additional terrestrial applications. The vertical directional diagram can be filled up in the direction towards lower elevation angles, for these signals, by way of different weighting in the superimposition of the two antennas. The monopole 7, configured as a rod antenna, possesses a similar main radiation direction as the horizontally polarized loop antenna 14, in terms of its vertical directional characteristic, but it provides a greater contribution for low elevation angles than the loop antenna 14. Using the non-symmetrical line-coupling and phase-shift network 31, the weighting of the properties of the two antennas can be adjusted differently, and in addition, the phase focal points can be brought close to one another.

Figure 10:
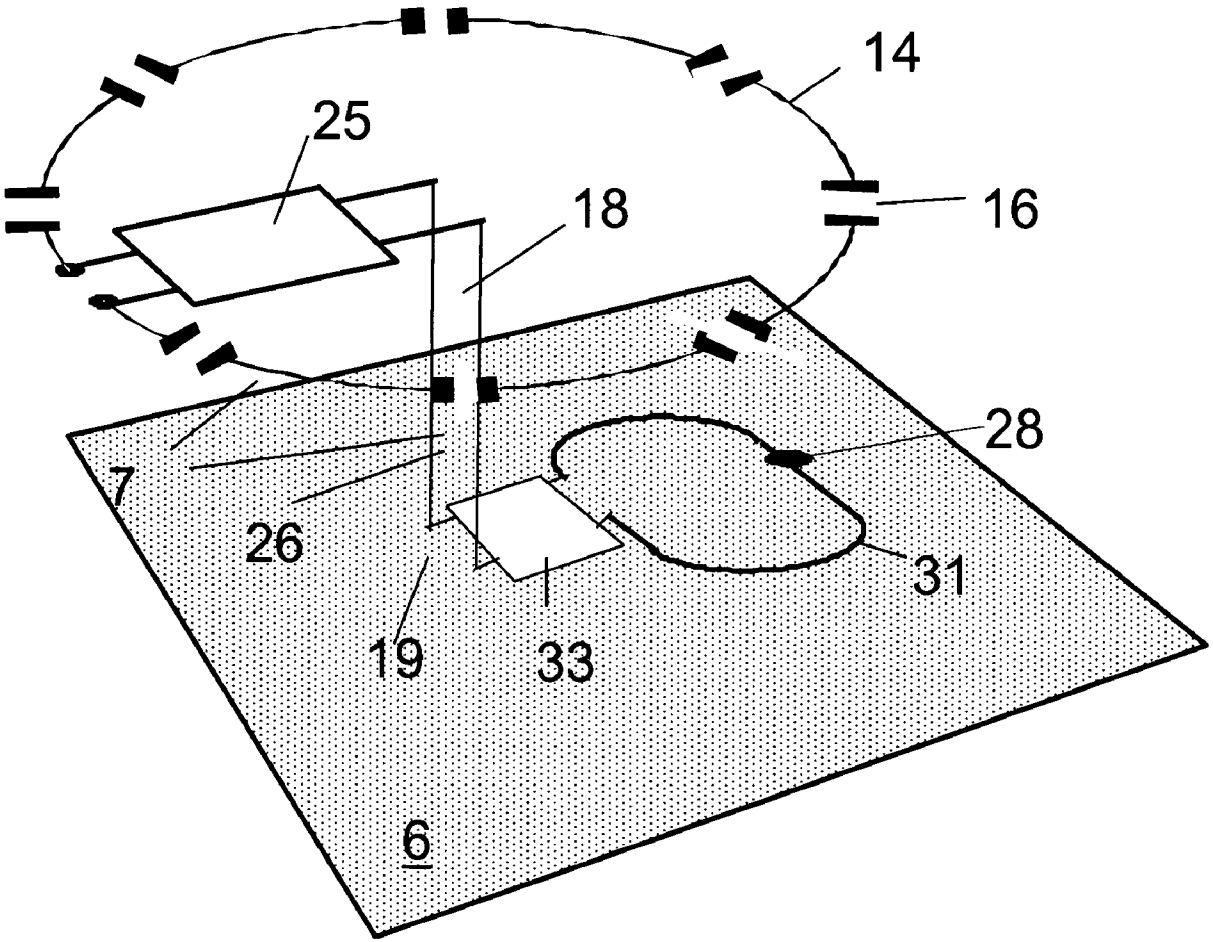
FIG. 10 is an antenna similar to FIG. 9, but with a vertical feed line for feeding the loop antenna.

In the case of the array in FIG. 10, the monopole 7 is implemented differently from the rod antenna in FIG. 9. The vertical two-wire line 26 that is provided to feed the loop antenna 14 is utilized as the monopole 7, whereby the loop antenna 14 serves as the roof capacitor 12 of the monopole 7. For this purpose, an additional uncoupling is created, whereby the loop antenna 14 is also used for a vertically polarized field, in a mode as the roof capacitor 12 of the monopole 7. If necessary, an adaptation network 33 is used for the monopole mode, which network is preferably configured in such a manner that the power-coupling and phase-shift network 31 mentioned above can be connected to it. Thus, the weighting of the antennas can be adjusted differently here, too, using this non-symmetrical power-coupling and phase-shift network 31, and the phase focal points can be brought close to one another. The adaptation of the impedance of the loop antenna 14 can take place using the adaptation network 25, which can be implemented, in a simple embodiment, as a $\lambda/4$-line transformer. Because of the vertically polarized receiving two-wire line 26 with the loop antenna 14 as a roof capacitor 12 relative to the ground plane 6, and because of the horizontally polarized receiving loop antenna 14 between the two conductors of the two-wire line 26, signals from vertical and horizontal field components are superimposed in the power-coupling and phase-shift network 31, which acts as a power splitter in the transmission case.

Figure 15:
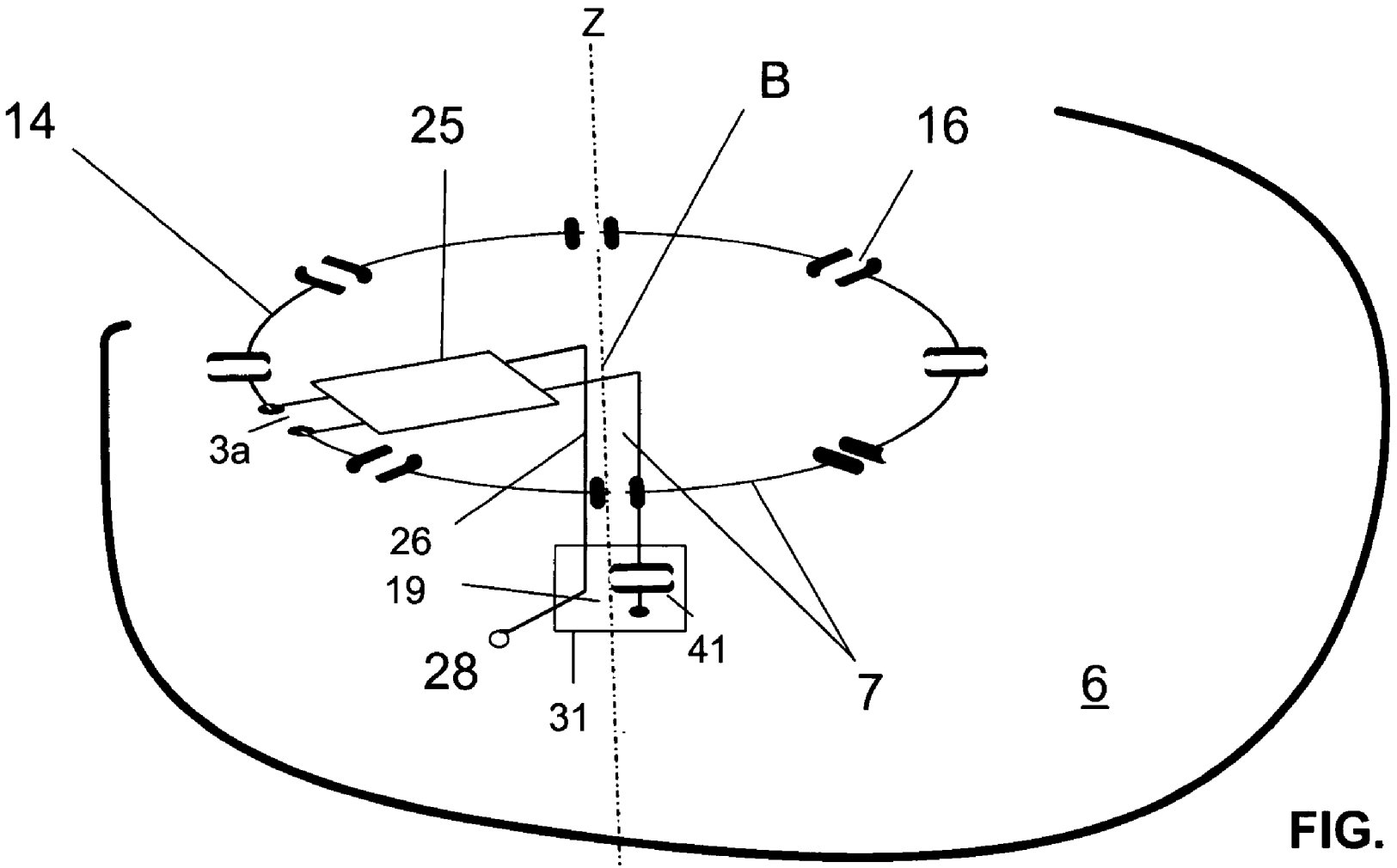
FIG. 15 is a schematic block diagram of an antenna array similar to FIG. 10, having a power distribution and phase-shift network 31 above the ground plane; 6, which can be implemented in extremely simple manner, as a reactance 41.

This property can be advantageously utilized, according to one embodiment of the invention, to support the radiation properties at low elevation, by means of phase-rigid combination of the vertically and horizontally polarized antennas, and at a selection of the same phase angle focal point (analogous to the phase reference point in the origin of the coordinate system according to the deliberations above). In this way, it is possible to generate a linearly polarized field that is preferably polarized horizontally at a higher elevation and polarized vertically at a lower elevation. FIG. 10 is an antenna similar to FIG. 9, but with a vertical feed line for feeding the loop antenna, whereby the feed line forms a monopole, and the loop antenna forms a roof capacitor of the monopole;

In an embodiment of the invention according to FIG. 15, the non-symmetrical power-coupling and phase-shift network 31 is implemented in the central foot point 19 of the antenna array, in that the one conductor of the two-wire line 26 is conductively connected with the conductive ground plane 6 by way of a reactance 41, and the other conductor of the two-wire line 26 is guided to the connection point 28 of the antenna array. The weighting of the reception of the horizontally polarized and the vertically polarized electrical field can be adjusted by means of the selection of the reactance 41. In the case of the example shown in FIG. 15, the reactance 41 is implemented by means of a capacitor whose size adjusts the desired weighting.

Figure 11:
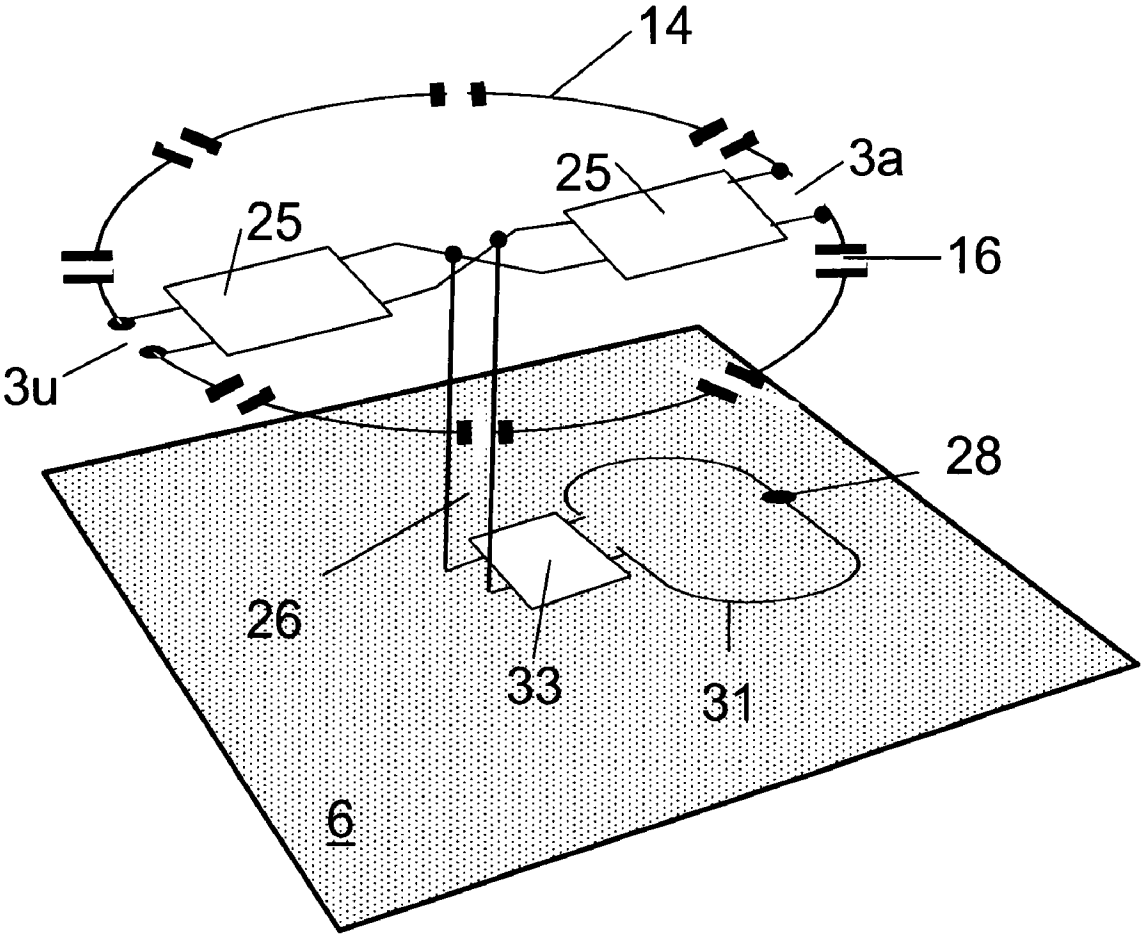
FIG. 11 is a loop antenna having two antenna connection points disposed symmetrically relative to one another; and one adaptation network each, in the loop plane, as well as having a central connection to a vertical feed line, as an alternative to FIG. 10.

The antenna described in FIG. 10 is implemented, in FIG. 11, in a symmetrical embodiment having a star-shaped, multi-arm horizontal feed and a central connection to a vertical feed, as an alternative to the one-arm "non-symmetrical" feed. In this manner, the omnidirectionality of the azimuthal directional characteristic is perfected. The example shows an embodiment with a two-arm symmetrical feed to the two antenna connection points 3*a* configured in the loop antenna 14. FIG. 11 is a loop antenna 14 having two antenna connection points disposed symmetrically relative to one another, and one adaptation network each, in the loop plane, as well as having a central connection to a vertical feed line, as an alternative to FIG. 10.

Figure 12:
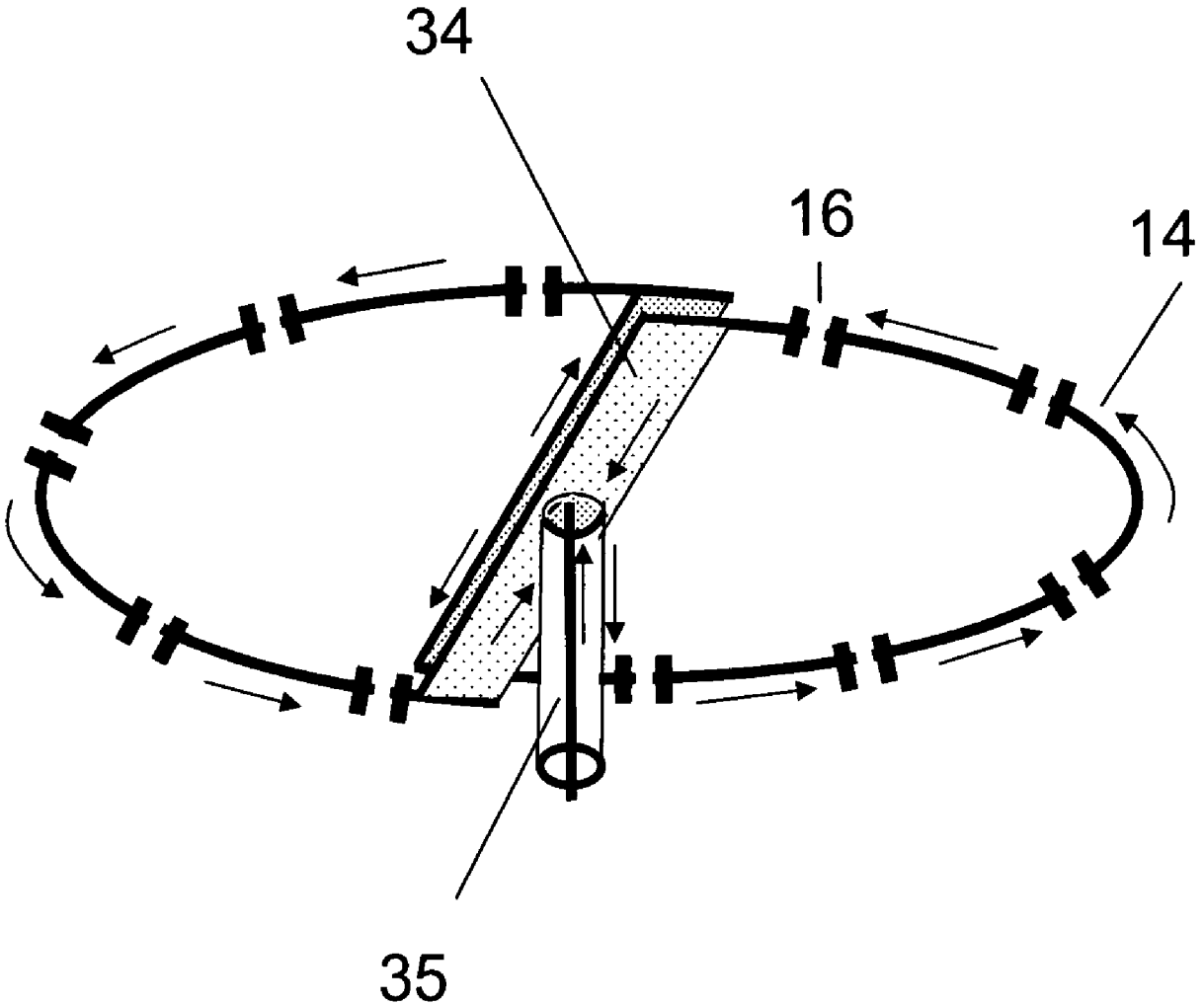
FIG. 12 is an embodiment with a two-part feed to the loop antenna, in the form of a ribbon conductor, with current paths marked by arrows.

FIG. 12 shows a particularly advantageous two-arm feed by way of ribbon conductors 34 of a loop antenna 14, and the current paths indicated with arrows. Here, the central vertical feed takes place in a coaxial embodiment, as an example, whereby the outer conductor of a coaxial line 35 is connected with the one ribbon, and the inner conductor is connected with the other ribbon of the ribbon conductor 34.

In another embodiment of the invention, as it will be described below using FIGS. 13A and 13C, a group of electrically very short conductor elements $\Delta_v$, which essentially run in a horizontal plane, is conductively joined together in a series, and thus an electrically short dipole 21 having almost the same phase of the currents on the conductor elements is configured, which dipole can be coupled to an antenna connection point 3*b* formed by means of an interruption point, or in the reciprocal transmission case can be supplied. Symmetrical to the common reference point B, in each instance, an electrically short dipole 21 having the same shape and the same orientation is correspondingly present, so that a corresponding conductor element on a corresponding dipole 21 exists for every electrically very short conductor element on the dipole 21, running essentially in the same plane. The two dipoles 21, which form a pair, are supplied with the same current, in terms of amount, in the reciprocal transmission case, at the antenna connection point 3*b*, in each instance. The arithmetical average of the phases of the currents, counted in the same direction, in each instance, of a dipole pair, possesses the same value for all the dipole pairs.

In an embodiment of the invention, the dipoles 21 are configured in a straight line and symmetrical to their antenna connection point 3*a*, and running in a horizontal plane, whereby the antenna connection points 3*a* of multiple dipole pairs which are disposed distributed equidistantly on a horizontal circle whose center point forms the common reference point B. The dipoles 21 are oriented perpendicular to the connection line to the center point of the circle. This results in a circular group antenna system as shown in its simplest form in FIG. 13A. The figure shows a symmetrical embodiment of an antenna according to at least one embodiment of the invention, having four dipoles 21 disposed in a square, and having a coupling network 10 disposed centrally in the phase center B, whose output forms the connection point 28 and, in the reciprocal transmission case, acts as a distribution network. The antenna connection points 3*a* are connected with one of the inputs 23 of the coupling network 10, by way of an electrical line 27, in each instance, whereby the dipole pairs are supplied with the same signals, in terms of amplitude and phase. Adjacent ends of adjacent dipoles 21 can be connected with one another by way of capacitors 16.

Figure 13A:
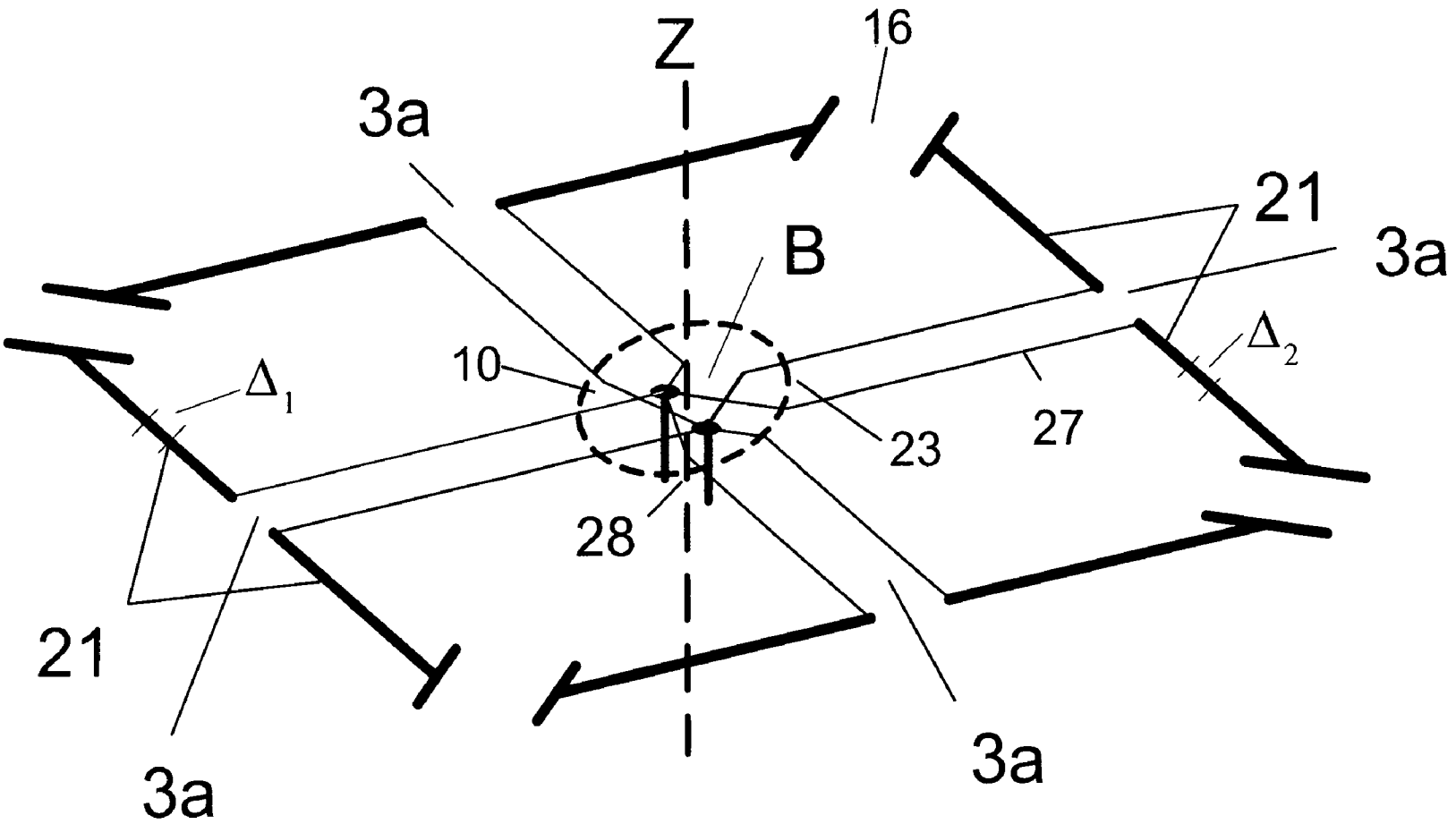
FIG. 13A is a symmetrical embodiment of an antenna according to the invention, having four dipoles.
Figure 13B:
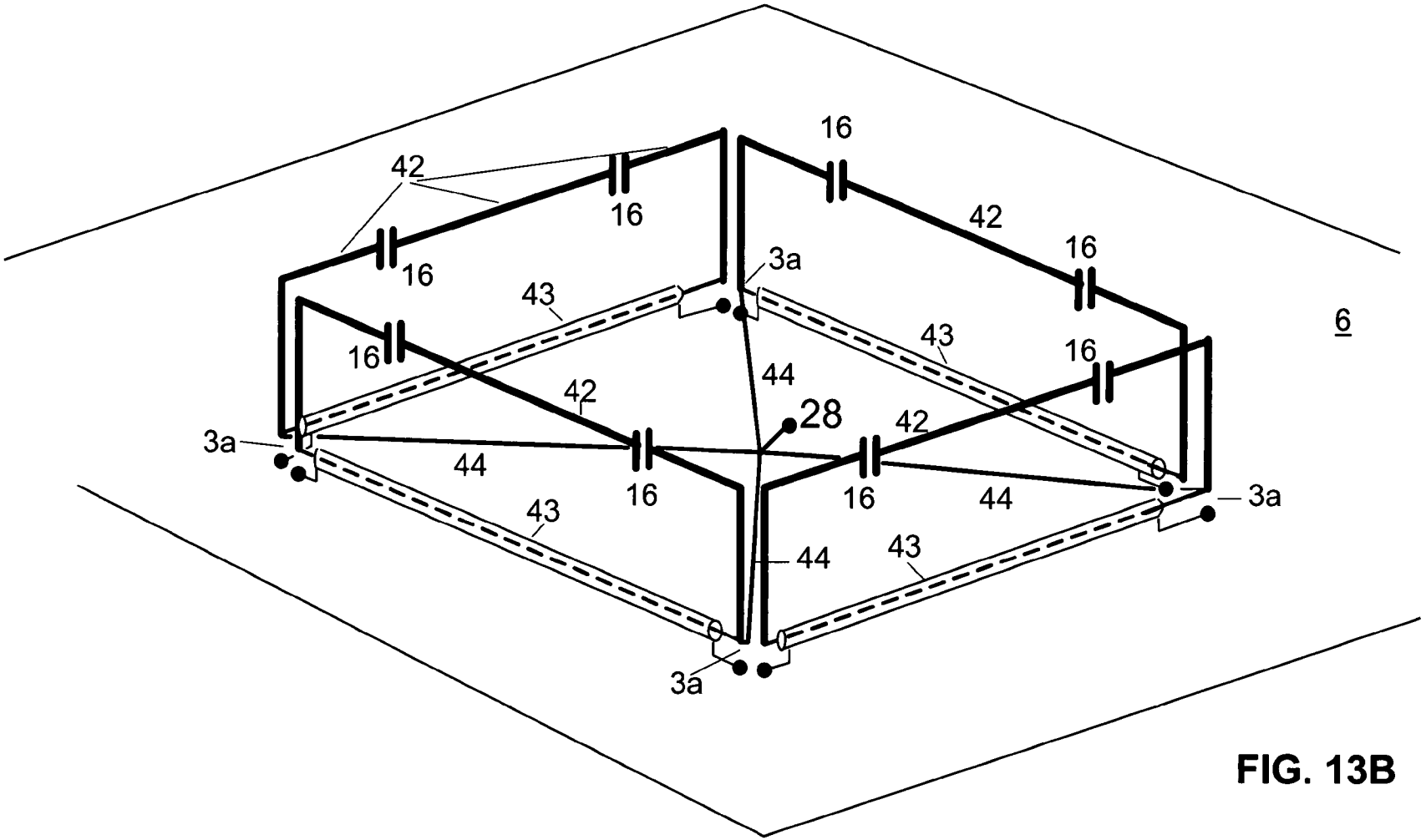
FIG. 13B is a symmetrical embodiment of an antenna, having four frame antennas; disposed in a square above a conductive ground plane.
Figure 13C:
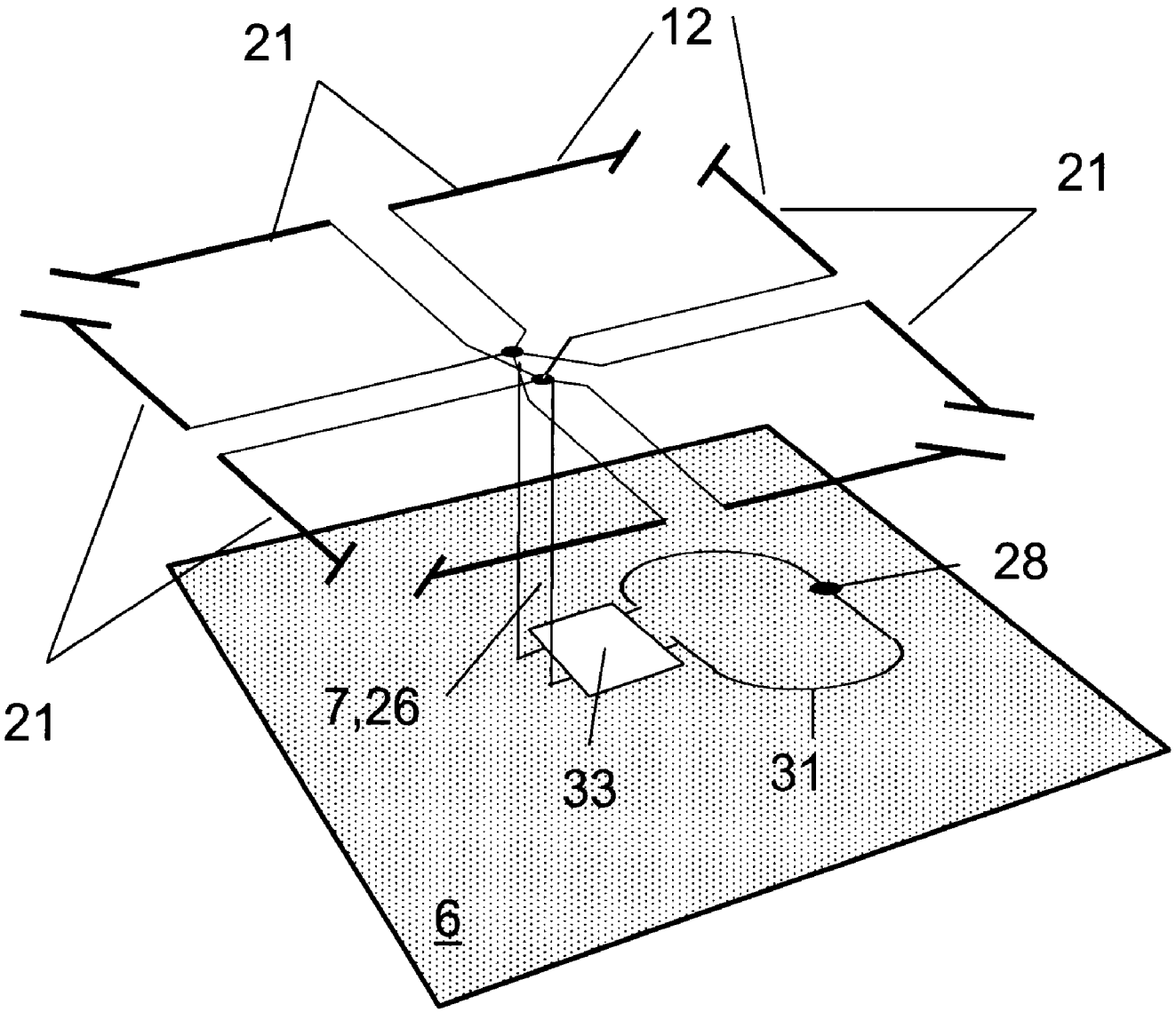
FIG. 13C is an antenna array similar to FIG. 13A, but with superimposition of received horizontal and vertical electric field components.

FIG. 13C shows a dipole array similar to FIG. 13*a*, but with superimposition of the reception of horizontal and vertical electrical field components, similar to FIGS. 10 and 11. The dipoles 21 additionally act as a roof capacitor 12 of the vertical monopole 7 formed by the two-wire line 26 in this manner.

Likewise, as shown in FIG. 13C, in an advantageous configuration of an embodiment of an antenna array according to FIG. 13*a*, the dipoles 21 disposed in a square can be combined with a monopole by way of a conductive ground plane 6 having central uncoupling—similar to the antenna in FIG. 10. In the case of this array, the vertical feed line is used as a monopole 7, in the form of the two-wire line 26, to supply the dipoles 21, with the dipoles 21 as the roof capacitor 12. Thus, here, too, the weighting of the effects of the dipoles 21 and of the monopole 7 formed in this manner can be adjusted differently, using the non-symmetrical power-coupling and phase-shift network 31 that acts as a power splitter in the reciprocal transmission case, in accordance with the requirements, and the phase focal points can be brought close to one another.

FIG. 13B shows a symmetrical embodiment of an antenna according to at least one embodiment of the invention, having four frame antennas 42, disposed in a square and above a conductive ground plane 6, the frame surfaces of which antennas are oriented perpendicular to the conductive ground plane 6. The frame antennas 42 are excited with λ/2-balun lines 43, symmetrical to the ground plane, so that an antenna connection point 3*a* is formed at one of the two foot points of each frame antenna 42, in each instance. Preferably, the λ/2-balun lines 43 shown as coaxial lines in the FIG. are implemented as microstrip lines. Each frame antenna 42 is uncoupled with a micro-strip line 44 having the same length, in each instance, proceeding from the common output connector 28 of the antenna array, in such a manner that all the horizontal frame parts are excited, following the same direction of rotation. The main direction of the vertical directional diagram can be adjusted with capacitors 16 introduced into the frame antenna 42, in the case of an azimuthal omnidirectional diagram. In addition, the antenna connection point 3*a* of each frame antenna 42 is connected with the common connection point 28 of the antenna array using an electrical line 44 having the same length, preferably implemented as a microstrip line 44, in such a manner that in the reciprocal transmission case, all the horizontal frame parts are excited following the same direction of rotation. The main direction of the vertical directional diagram can be adjusted using the capacitors 16 introduced into the frame antennas 42, by means of the selection of the position and capacitance value of the capacitors 16 in the case of an azimuthal omnidirectional diagram. In the case of such a connection method, the radiation effects of the vertical components of the frame antennas 42 cancel one another out.

FIG. 13C is an antenna array similar to FIG. 13A, but with superimposition of received horizontal and vertical electric field components; as explained in connection with FIGS. 10 and 11, wherein the dipole system acts as a roof capacitor of the vertical monopole formed in this manner.

In another embodiment of the invention, not shown, an electrically short monopole 7 and a distribution or coupling network 10 are present at the central phase reference point B of a circular group antenna system having horizontally oriented dipoles 21, similar to FIGS. 13*a* and 13*c*. The output 24 of the coupling network 10 is configured as a connection point 28 of the antenna array, and the antenna connection points 3*a* of the antennas in the circular group and of the monopole 7 are supplied by the coupling network 10, in the reciprocal transmission case, by way of an electrical line 27, in each instance, in such a manner that the phases of the current fed into the monopole 7 correspond to the phase position of the currents fed into the circular group antenna, with reference to the common phase reference point B. Finally, multiple electrically short vertical monopoles 7 can also be disposed in pairs, symmetrical to the central phase reference point, and, in the reciprocal transmission case, can be supplied by way of the coupling network 10, in such a manner that the arithmetical average of the current phases of the monopoles 7 disposed in pairs, and the phase of the current current fed into the central monopole 7 are the same with reference to the phase reference point B, in each instance.

Figure 14:
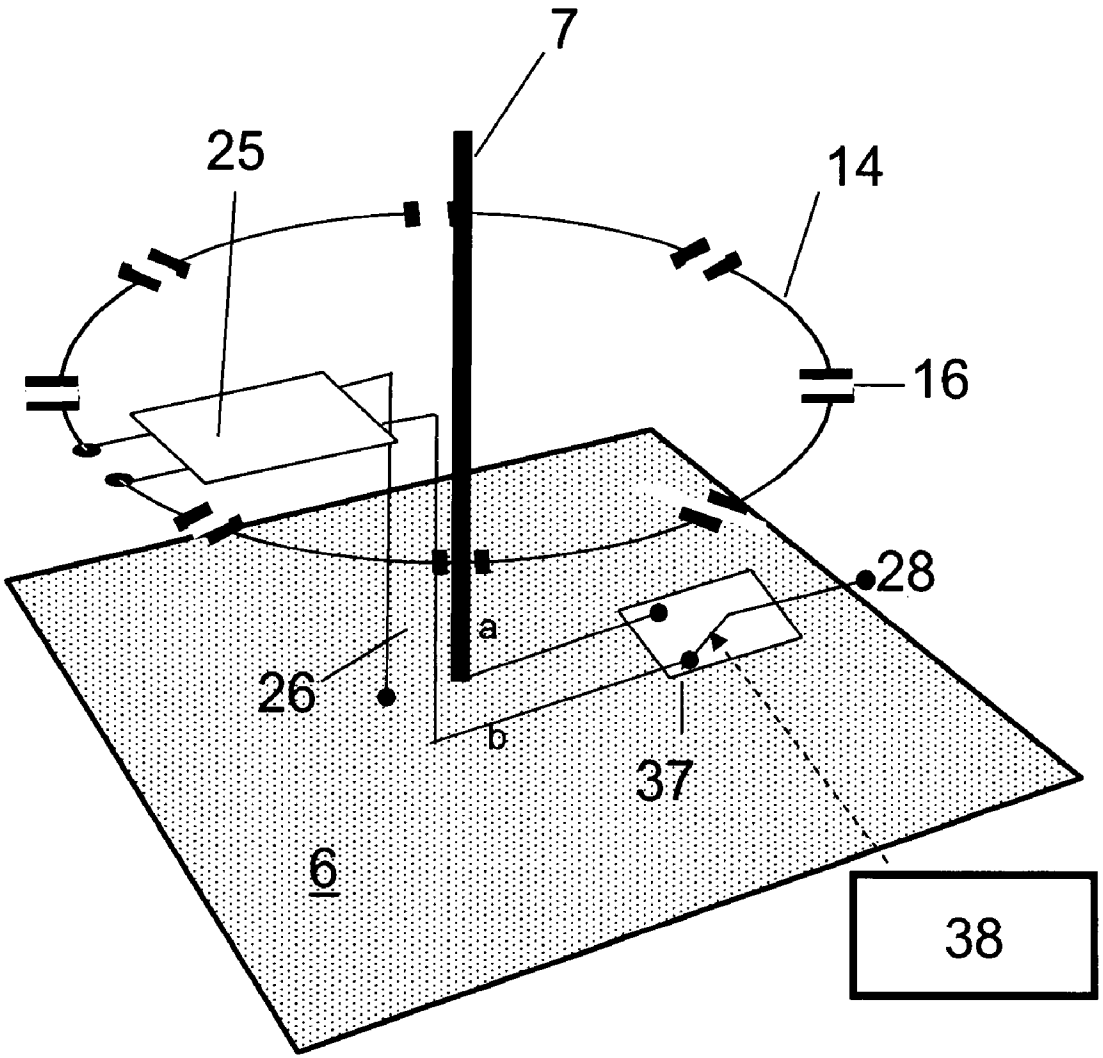
FIG. 14 is an antenna array according to the invention, as a diversity reception antenna, having a correspondingly configured distribution network.

FIG. 14 is an antenna array according to one embodiment of the invention, as a diversity reception antenna, having a correspondingly configured distribution network; 10 for making available both the reception signals of the loop antenna 14 having horizontally oriented conductor elements, and the reception signals of the vertical monopole 7;

Thus, the coupling network 10, as shown FIG. 14, is configured for use of the antenna as a diversity reception antenna, in such a manner, specifically, that both the reception signals of the antennas having horizontally oriented conductor elements and those of the vertical monopole 7 are available separately from one another, in each instance. This is done, in the simplest case, using a diversity change-over switch 37, which is controlled by a diversity module 38. In this connection, the reception signals of the two antennas are received with their own radiation characteristics, which are, however, the same for both directions of the circular polarization.

Particularly in vehicle construction, the compatible expansion of simple devices in the direction towards particularly high-performance and therefore more complicated devices, in economical manner, is particularly important. A particular advantage of an antenna array according to one embodiment of the invention consists in the possibility of combining an essentially horizontally polarized antenna and an essentially vertically polarized antenna, in order to achieve separate connections for circularly polarized waves of both directions of rotation. For example, the loop antenna 14 can be combined with the vertical monopole 7 having the common phase center B in FIG. 9, either in fairly uncomplicated manner, using the power-coupling and phase-shift network 31, as was described in connection with FIG. 9, or the antenna connection points 3*a*, 3*b* of the two antennas are combined with different signs in a more complicated form, by means of a 90° phase circuit, in such a manner that they are available at an LHCP connector 46 and an RHCP connector 47, separated according to LHCP and RHCP waves, respectively. In this connection, it is particularly advantageous that with the existing basic form of the design of the antenna array, combined from the loop antenna 14 and the monopole 7, both the fairly uncomplicated operating form to accomplish the task according to one embodiment of the invention, and the expansion for separate representation, for operation for LHCP and RHCP waves, respectively, can be implemented in economically efficient manner.

Figure 19A:
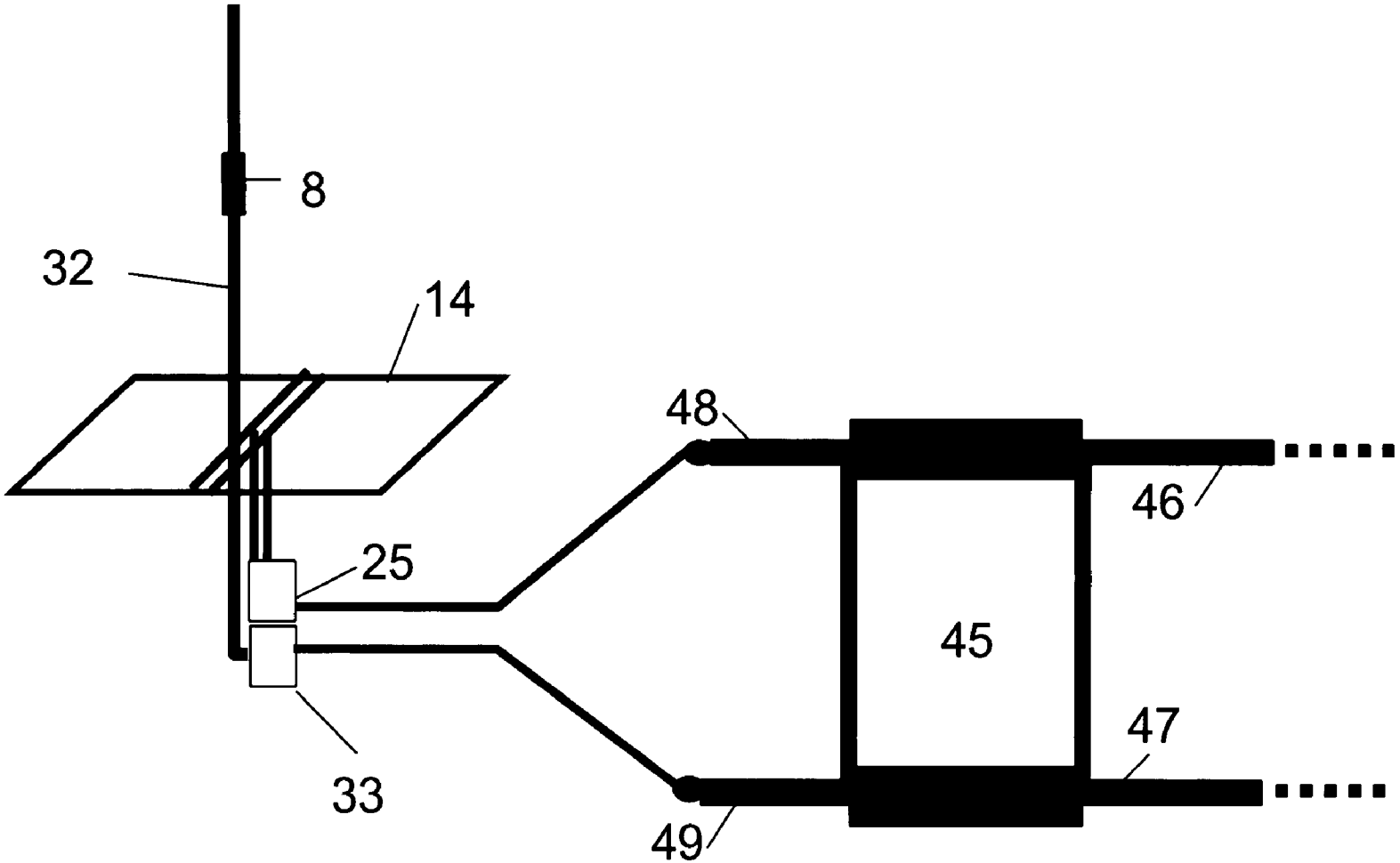
FIG. 19A is a schematic block diagram of an antenna array having a vertically polarized monopole configured as a rod antenna, and a horizontally polarized loop antenna.

FIG. 15 is a schematic block diagram of an antenna array similar to FIG. 10, having a power distribution and phase-shift network 31 above the ground plane; 6, which can be implemented in extremely simple manner, as a reactance 41;

FIG. 16 is a schematic block diagram of an antenna array similar to the examples in FIGS. 8 to 15; having a plane of symmetry SE oriented perpendicular to the ground plane 6 and symmetrically with reference to the antenna connection point 3*a* of the antenna 24 for another radio service or multiple other radio services, configured in linear or planar manner, and assigned to the antenna array;

FIG. 17 is a schematic block diagram of a circular group antenna system 9 consisting of equal parasitic radiators 11 disposed on a circle K; around the phase center B, adjacent to one another at equal angle distances W, in each instance, above a conductive ground plane 6, having a monopole 7 with roof capacitor 12 disposed in the phase center B, whose antenna connection point at the same time forms the antenna output connector 28 of the circular group antenna system 9;

FIG. 18 is a schematic block diagram of a circular group antenna system 9 similar to FIG. 17, but with multiple monopoles 7; each having a separate antenna connection point 3*b*, a reactive device 8, and an electrical line 27 to one of the inputs 23 of a distribution network 10, the output of which forms the output connector 28 of the circular group antenna system 9. The antenna connection point 3*b* of a central monopole 7 is also connected with one of the inputs 23 of the distribution network 10;

FIG. 19A is a schematic block diagram of an antenna array having a vertically polarized monopole 7 configured as a rod antenna, and a horizontally polarized loop antenna 14; according to one embodiment of the invention, having a common phase center B, with reference to the transmission case, as in FIG. 9, but with separate feed of the signals to the connector for vertical polarization 49, or to the connector for horizontal polarization 48, respectively, of a hybrid coupler 45 with 90° positive and negative phase difference, respectively, with reference to the LHCP connector 46 and the RHCP connector 47 for separate availability of LHCP and RHCP signals, respectively, Antennas for circularly polarized waves are usually implemented, according to the state of the art, in that similar antennas—such as two crossed dipoles or two crossed frame antennas, for example—are wired together by way of a 90° phase circuit. In contrast to this, in the present case—as shown in FIG. 19*a*—a circularly polarized antenna is formed from two different antennas according to one embodiment of the present invention, whose vertical directional diagrams have the same coverage and whose main direction is structured appropriately for reception of the satellite signals. The uniformity of the directional diagrams can be implemented, for example, by means of the selection of the structure of the monopole 7 as a rod antenna with a reactive device 8—similar to the antenna described in connection with FIG. 3—as well as by means of appropriate configuration of the loop antenna 14—as described in connection with FIG. 7. The uniformity of the phase center B of the two antennas can be brought about using the adaptation network 25 for the loop antenna 14, or the adaptation network for the monopole mode.

For implementation of such an antenna—as shown in FIG. 19A—the vertically polarized and the horizontally polarized antenna 7 and 14, respectively, according to one embodiment of the invention, with a common phase center B as in FIG. 9, but with separate feed of the signals to the connector for vertical polarization 49, or to the connector for horizontal polarization 48, respectively, of a hybrid coupler 45, with a 90° positive or negative phase difference with reference to the LHCP connector 46 and the RHCP connector 47, respectively, can take place for separate generation of LHCP and RHCP signals, respectively.

Figure 19B:
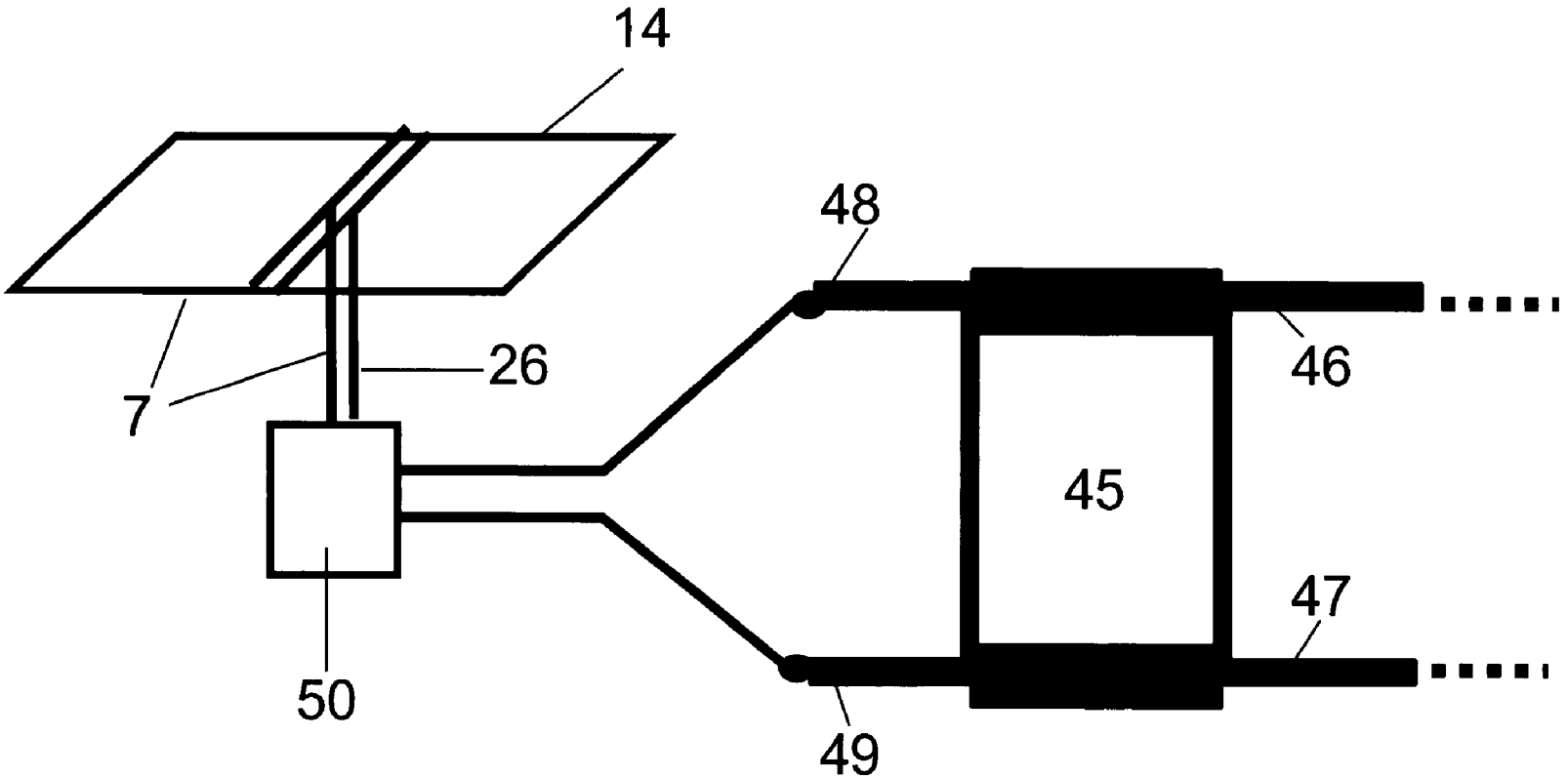
FIG. 19B is an antenna array as in FIG. 19A, but with implementation of the monopole according to the antenna array in FIG. 10, by means of combining the effects of the loop antenna as a roof capacitor and of the two-wire line.

A similar antenna array is shown in FIG. 19B, but the implementation of the monopole 7, similar to the antenna array in FIG. 10, takes place by means of the combination of the loop antenna 14 that acts as a roof capacitor, and of the two-wire line 26. Using a combined adaptation circuit 50, both the adaptation of the loop antenna 14 and the adaptation of the monopole 7, as well as setting of a common phase center B, are assured.

Figure 20:
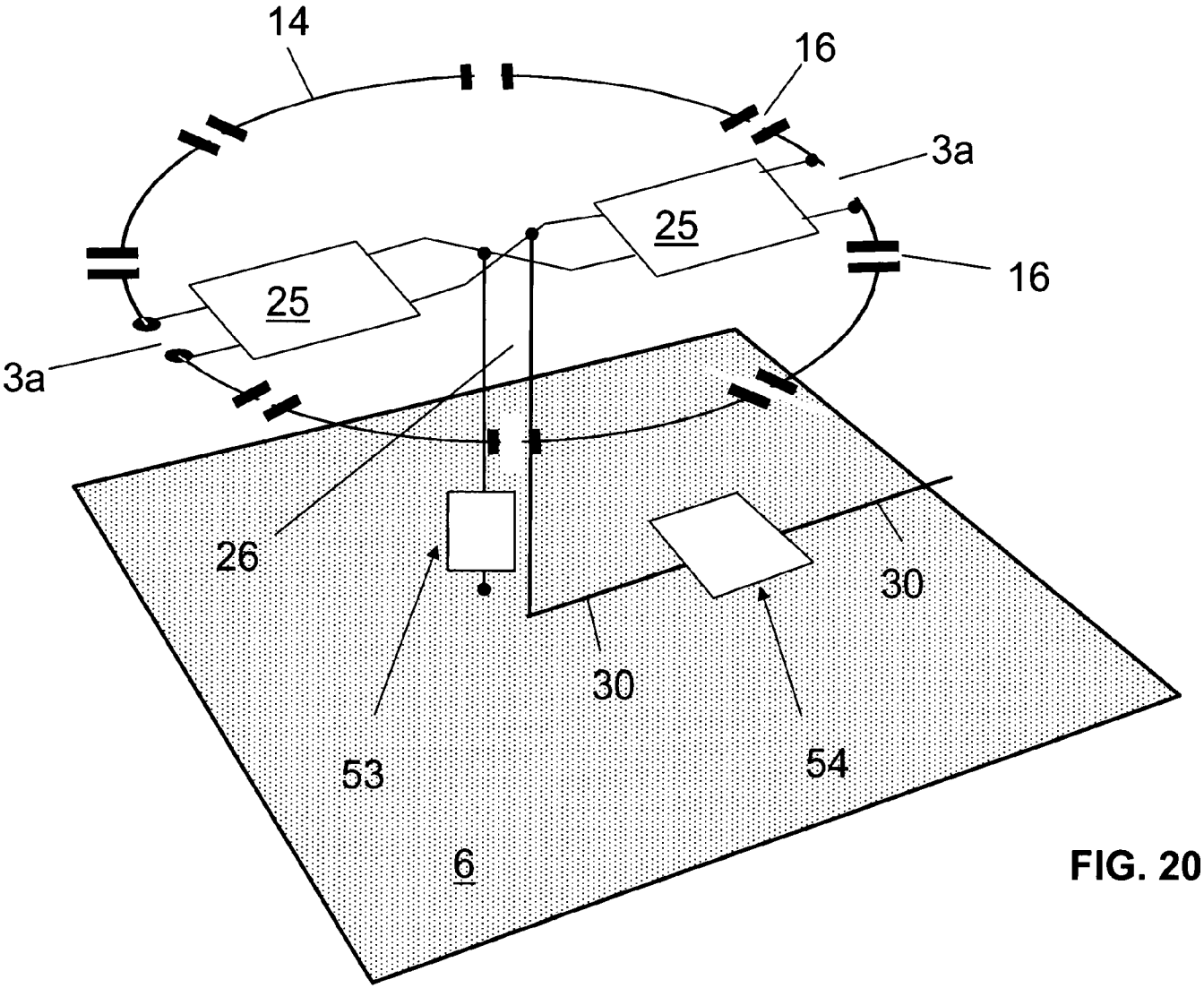
FIG. 20 is an antenna array with same-phase superimposition of the reception voltages from the horizontal and the vertical electrical field components of a loop antenna and a monopole antenna.
Figure 21A:
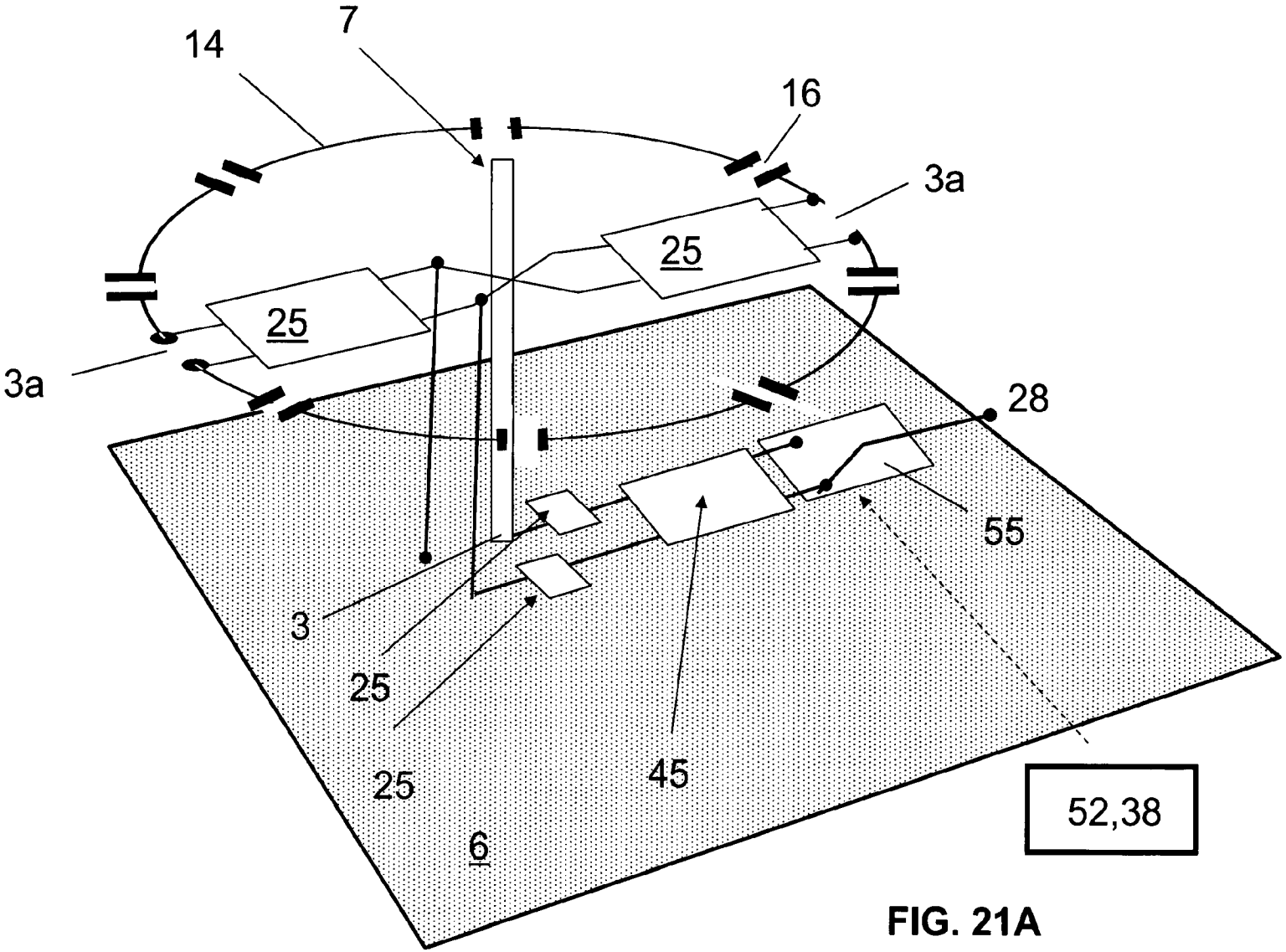
FIG. 21A is an antenna array for alternative uncoupling of RHCP and LHCP signals, respectively, having a loop antenna with two antenna connection points 3 that lie opposite one another.

FIG. 20 is an antenna array with same-phase superimposition of the reception voltages from the horizontal and the vertical electrical field components of a loop antenna 14 and a monopole antenna 7 formed by means of the vertical two-wire line 26. Using a network 53 introduced into the conductor of the two-wire line 26, adjustment of the same-cycle to counter-cycle ratio takes place on the vertical two-wire line 26, thereby adjusting the ratio of the component of the vertically polarized field with a lower elevation of the main radiation direction to the component of the horizontally polarized field having a higher elevation of the main radiation direction. In the simplest case, this network 53 can be configured as a capacitor;

In another advantageous antenna array for alternative uncoupling of RHCP and LHCP signals, respectively, as shown in FIG. 21A, a loop antenna 14—as shown in FIG. 11—is provided, with two antenna connection points 3*a* that lie opposite one another, and adaptation networks 25 connected with them and situated in the loop plane, which networks are preferably implemented as λ/4-transformation lines. The outputs of the adaptation networks 25 are switched in parallel, and add up. The reception signal is passed to an adaptation network 25 situated on the ground plane 6, by way of the two-wire line 26, the output of which network in turn is connected to one of the two inputs of a signal combination circuit, particularly one configured as a 90° hybrid coupler 45. An adaptation network 25 is also connected at the antenna connection point 3*b* at the foot point of the monopole 7, situated in the center of the array and configured as a rod antenna, the output of which network supplies the other of the two inputs of the 90° hybrid coupler 45. An LHCP/RHCP change-over switch 55 connected with the outputs of the 90° hybrid coupler 45 makes satellite reception signals of the two directions of rotation of the polarization alternatively available at the connection point 28, controlled by a change-over switch situated in a radio receiver module 52. When controlled by a diversity control module 38, the antenna array can also be used, in advantageous manner, for polarization diversity, by means of switching over between reception for LHCP and RHCP waves.

Figure 21B:
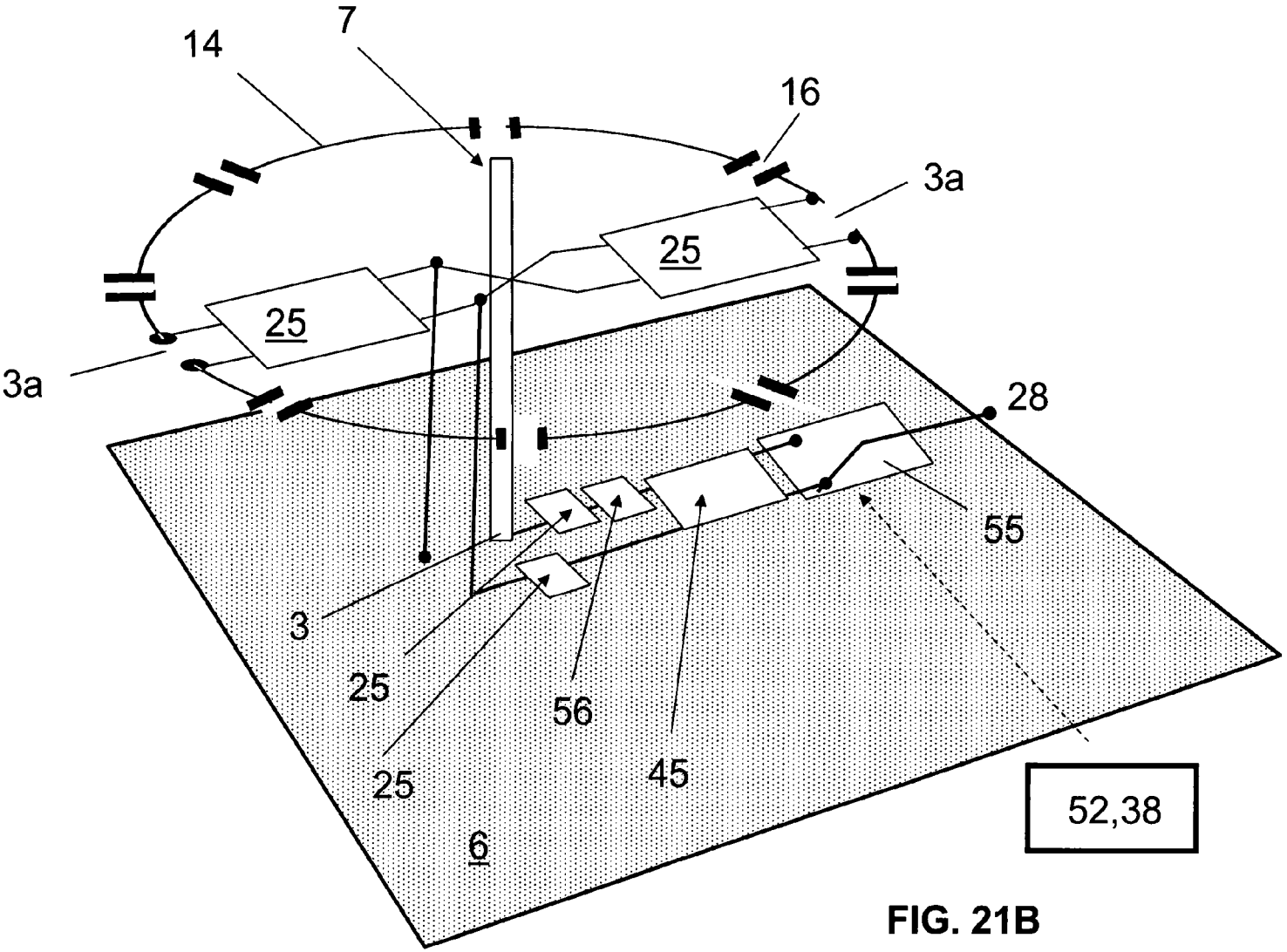
FIG. 21B is a variant of the antenna array, which also allows reception of elliptically polarized fields.

Also, as shown in FIG. 21*b*, in a variant of FIG. 21*a*, the axis ratio of the circularly or elliptically polarized field can be adjusted by means of the introduction of an attenuation element 56 into the path of the monopole 7 from the loop antenna 14. With increasing attenuation, the main radiation direction of the antenna increases in elevation, and the antenna can be optimized for optimal interference resistance with regard to horizontally incident interference and temperature-related external noise. By means of supplementing the attenuation element 56 in FIG. 21*b* with a phase-rotation element (not shown), not only the ellipticity but also the direction of rotation of the polarization, and the elevation of the main radiation direction of the antenna can be adjusted, by means of adjusting the phase with attenuation, according to one embodiment of the invention. The change-over switch 55 can be eliminated, if applicable.

Figure 22:
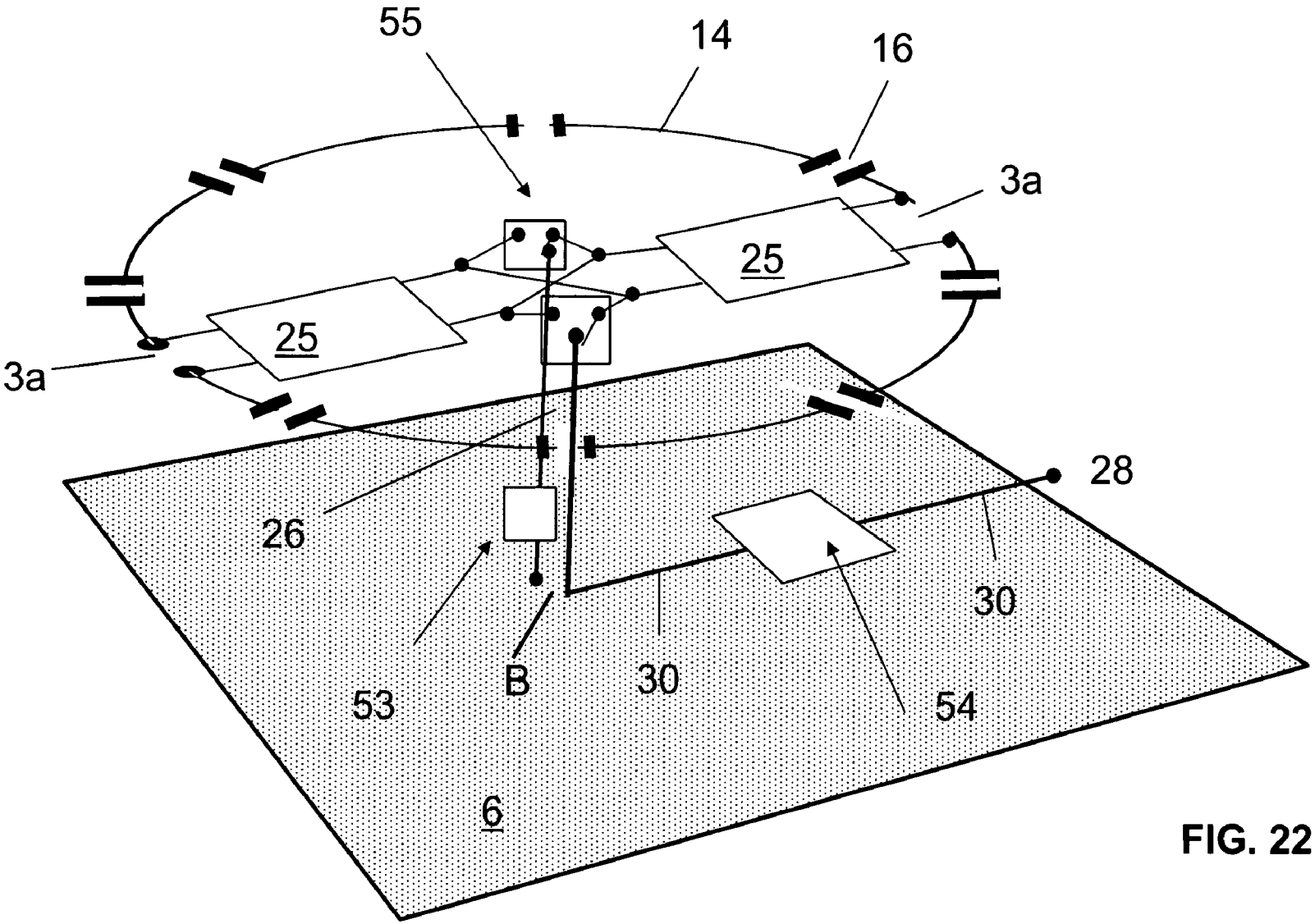
FIG. 22 is an antenna array similar to the variant of FIG. 21A, in which, however, the monopole is formed by a two-wire line, analogous to the antenna in FIG. 11, which line connects the loop antenna with the conductive ground plane 6.

In another particularly efficient embodiment of such an antenna having a circularly or elliptically polarized field, with a switchable direction of rotation, the separate monopole 7 is eliminated in FIG. 22—similar to the antenna in FIG. 11. For reception in the case of vertical polarization, the two-wire line 26 is utilized here, as well. By means of insertion of a suitably configured network 53 into one of the strands of the vertical two-wire line 26, the difference of 90° between the phases of the horizontal field component picked up by the vertical two-wire line 26 with the loop antennas 14 as the roof capacitor 12 and by the loop antenna 14 is adjusted in such a manner that their combination with this phase difference is present at the microstrip conductor 30 to the adaptation network 54, and thus also at the connection point 28. As a result, the antenna receives a circularly polarized field. A circuit that links the reception signals of the loop antenna 14 at the output of the adaptation networks 25 from the horizontally polarized electrical field and the reception signals of the vertical two-wire line 26 from the vertically polarized electrical field comprises an LHCP/RHCP change-over switch 55 for reversing the polarity of the reception voltage of the loop antenna 14. In this manner, the latter can be added with a different sign of the reception voltage from the vertically polarized field, so that a switch can be made between reception of LHCP field and RHCP field, by means of switching over the LHCP/RHCP change-over switch 55.

As already explained in connection with the antenna in FIG. 15, here, too, a network 53 of reactances, corresponding to the network 31, in accordance with FIG. 20, can be wired into the strand of the vertical two-wire line 26 that is connected with ground, to configure the vertical directional diagram of the linearly vertically polarized antenna. Using the network 53, the setting of the same-cycle to counter-cycle ratio can be set on the vertical two-wire line 26. In contrast to the antennas described above in FIGS. 21A and 22, the network 53 should be configured in such a manner that the reception voltages from the horizontal and the vertical electrical field components are superimposed with the same phase. In the simplest case, this network 53 can be configured as a capacitor. By means of setting the same-cycle to counter-cycle ratio on the vertical two-wire line 26, the ratio of the proportion of the vertically polarized field at lower elevation of the main radiation direction to the proportion of the horizontally polarized field at higher elevation of the main radiation direction of the overall characteristic can be adjusted. Thus, the elevation of the main radiation direction can be freely selected between the elevation angles 0° (horizontal) and 45°, by means of configuring the network 53. FIG. 21A is an antenna array for alternative uncoupling of RHCP and LHCP signals, respectively, having a loop antenna 14 with two antenna connection points 3 that lie opposite one another, and adaptation networks 25 connected with them, and a monopole 7 situated in the center of the loop antenna 14, in the form of a rod antenna. The reception signals of the two antennas are superimposed in a 90° hybrid coupler 45, at the outputs of which an LHCP/RHCP converter 55 is connected. The signals of the two directions of rotation of the polarization are alternately available, controlled by a change-over switch situated in the receiver, between LHCP and RHCP satellite reception signals;

FIG. 21B is a variant of the antenna array, which also allows reception of elliptically polarized fields while FIG. 22 is an antenna array similar to the variant of FIG. 21A, in which, however, the monopole 7 is formed by a two-wire line 26, analogous to the antenna in FIG. 11, which line connects the loop antenna 14 with the conductive ground plane 6.

For the configuration of satellite reception antennas according to one embodiment of the invention, which are uniformly suitable for the reception of left-rotating circularly polarized signals and also for the reception of right-rotating circularly polarized signals, the following characteristics and combinations of characteristics have proven to be preferred:

1. By means of configuring electrically very short conductor elements Δ1, Δ2, . . . of the antenna 1, it is assured that in accordance with the reciprocity law that applies between reception antennas and transmission antennas, when transmission power is fed into at least one antenna connection point 3*a*, 3*b* of the antenna, the electrical field intensity vector $\vec{E}_v$ generated in the remote field is polarized at every point $\overline{P}$ in space, at every point in time, along a fixed straight line specific to this point P in space.

This condition can be met, for example, if all the conductor elements Δ1, Δ2 are disposed along an extended line 2 and conductively connected with one another, so that essentially, a rod-shaped conductor 4 is formed, and the antenna connection point 3*b* is formed by means of an interruption of the rod-shaped conductor 4.

The essentially rod-shaped conductor 4 is preferably affixed essentially perpendicular over an essentially horizontal conductive ground plane 6, and has an interruption point by means of which the antenna connection point 3*b* is formed. Preferably, the essentially vertical monopole 7 formed in this way has at least one interruption point 5, to configure the vertical diagram, which point is wired up with at least one reactive device 8. The antenna connection point 3*b* formed in the foot point of the monopole 7, for configuring the optimal reception in the range of an elevation angle between 25° and 65°, can contribute about ⅝λ of the satellite signals to be received in the total length h2 of the monopole 7, whereby the interruption point 5 is affixed at a height h1 of about ⅜λ-⅝λ above a conductive ground plane 6 and wired up with a reactance 8 of approximately 200 ohms that is inductive at this frequency (FIG. 3).

2. The conductor elements $\Delta_1$ $\Delta_2$, . . . can be disposed along multiple straight lines extended parallel to one another, so that multiple rod-shaped conductors 4 are formed, where the antenna connection point 3*b* is configured in at least one of them. In this connection, the rod-shaped conductors 4 can be oriented vertically above the essentially horizontal conductive ground plane 6.

For example, in order to configure an essentially omnidirectional directional diagram, a circular group antenna system 9 having rod-shaped conductors 4 having the same configuration, as parasitic radiators 11, can be provided, whereby in the center Z of the circular group antenna system 9, an antenna according to the above Number 1 and a sufficiently large number of parasitic radiators disposed on a circle, at the same angle distance W from one another, are provided, in accordance with the requirements concerning omnidirectionality of the azimuthal directional diagram.

The circular group antenna system 9 contains a distribution network or a coupling network having multiple connectors 23, whereby one (24) of the connectors is structured as an antenna connection point 3*a*, and the rod-shaped conductors 4, which have the same structure and are disposed in the circular group, each contain an interruption point 5, and thus are configured as radiators 7, are connected, by way of the same type of electrical line 27, in each instance, to one of the other connectors of the network 10, in each instance, and, in the reciprocal transmission case, can be supplied with the same signals, according to amplitude and phase, whereby the emitter 7 situated in the center Z of the circular group antenna system 9 is also connected with one of the connectors of the network 10, to configure the directional diagram, and can be supplied with a signal having a separate amplitude and phase. Alternatively, in place of the emitter 7, a parasitic emitter 11 can also be affixed in the center Z of the circular group. Also, the rod-shaped conductors 4 disposed in the circle can also contain at least one interruption point 5 wired up with at least one reactive device 8, in each instance, to configure the vertical diagram. The same holds true for the rod-shaped conductor disposed in the center Z of the circular group, which can contain at least one interruption point 5 wired up with at least one reactive device 8, to configure the vertical diagram. In order to configure rod-shaped conductors that are as low as possible, these can contain a roof capacitor 12 at their upper end, and thereby have a lengthened effect. Furthermore, the circular group antenna system 9 can also consist of multiple rod-shaped conductors disposed in concentric circles and having the same structure in each circle, which are excited the same way, in terms of amount and phase, as necessary.

3. In a preferred embodiment, the antenna consists of a plurality of electrically very short conductor elements Δ1, Δ2 and Δ3, Δ4 and Δ5, Δ6, respectively, which are disposed in pairs, symmetrical to a common reference point in space, in each instance, in the manner indicated, and have the same orientation, whereby—as a result of the excitation of the antenna at the antenna connection point 3*a*—these act in pairs as emitting elementary antennas $\Delta_n$, $\Delta_m$, specifically in such a manner that the current that flows in the two elementary antennas $\Delta_n$, $\Delta_m$ that belong to an elementary antenna pair is the same, in terms of size, and the reference point for all the elementary antenna pairs $\Delta_n$, $\Delta_m$ form a common phase center B, in such a manner that the arithmetical mean of the phases of the two currents of an elementary antenna pair, counted in the same direction, in each instance, possesses the same value for all the elementary antenna pairs $\Delta_n$, $\Delta_m$.

Preferably, a loop antenna 14 having an antenna connection point 3*a* configured at one location, by means of interruption of the loop, is formed by means of conductive joining together in series of electrically very short conductor elements about the common reference point, whereby the dimensions of the loop are electrically sufficiently small so that the ring current is the same at every point, in terms of amount, and each very short conductor element is supplemented by a corresponding very short conductor element, to form a pair. It is practical if all the conductor elements $\Delta_1$, $\Delta_2$, . . . run in one plane, whereby the loop antenna 14 can have the shape of a regular n-gon, whose phase reference point is given by the point of symmetry of the n-gon, or the shape of a circular ring, whereby here, reference point B is given by the center point of the circular ring. The loop antenna 14 can also be formed from multiple closed loops having a common phase reference point B, but the antenna connection point 3*a* must be configured in one of the loops, by means of interruption. In this connection, the loop antenna 14 can be configured from multiple loops conductively connected with one another in series, in planes that are essentially parallel to one another, at the smallest possible distance from one another, in the form of a coil, so that an essentially common phase reference point is formed for all the loops, and the antenna connection point 3*a* is provided by the two ends of the spiral.

If the loop antenna 14 is not electrically small, it can contain multiple capacitors 16 introduced at interruption points 5, thereby sufficiently assuring the constancy of the current on the conductor elements $\Delta_1$, $\Delta_2$, in terms of amount and phase (FIG. 5*a*). It is preferred that the loop antenna 14 is configured in circular shape or approximately square in a plane parallel to an essentially horizontal conductive ground plane 6, and has capacitors 16 introduced at interruption points, which configure both the constancy of the current on the conductor elements $\Delta_1$, $\Delta_2$ and the vertical diagram.

To configure the reception in the range of an elevation angle between 25° and 65° with azimuthal omnidirectional characteristics, the loop antenna 14 is preferably placed at a distance of about 1/16 to 1/8 of the wavelength above the conductive ground plane 6, whereby the side length of the loop antenna 14 is selected to be about 1/4 of the wavelength, and an interruption point wired up with a capacitor having a reactance of about −200 ohms is introduced at intervals of about 1/8 of the wavelength, in each instance (FIGS. 5*b* and *c*).

In a preferred embodiment, an electrically short vertical monopole 7 and a distribution network 10 are provided at the central phase reference point, the output of which is structured as an antenna connection point 3*b*, and the loop antenna 14 and the monopole 7 are supplied in accordance with the reciprocity law that applies between reception antennas and transmission antennas, by way of an electrical line, in each instance, by an output of the distribution networks, in such a manner that the phases of the current fed into the monopole 7 and into the loop antenna are the same, in each instance (FIG. 9). For this purpose, the distribution network is configured as a power-splitter and phase-shift network 31, with separate connectors for the loop antenna 14 and the monopole 7, in such a manner that the phases of the current fed into the monopole 7 and into the loop antenna 14 are almost the same, to form the common phase center B, taking the mirror effect at the ground plane 6 into consideration, and the fact that the weighting in connection with the superimposition of the effects of the loop antenna 14 and of the monopole 7 is adjusted in such a manner that while the main direction of the resulting vertical directional diagram is adjusted for satellite reception, the directional diagram is filled up towards low elevation angles, because of the effect of the monopole 7 (FIG. 9).

4. In another preferred variant, a group of electrically very short conductor elements $\Delta_1$, $\Delta_2$ that run essentially in a horizontal plane is connected in series, in electrically conductive manner, in such a manner that they form multiple electrically short dipoles 21 having almost the same phase of the currents on the conductor elements $\Delta_1$, $\Delta_2$, which are supplied at a dipole connection point 22 formed by means of an interruption point, whereby an electrically short dipole 21 formed in the same way is correspondingly present, in each instance, symmetrical to the common reference point B, so that a corresponding conductor element $\Delta_2$ exists on the corresponding dipole 21, running in essentially the same plane, for every electrically very short conductor element $\Delta_1$ on a dipole, and, if two dipoles 21 that form a pair are supplied with the same current, in terms of amount, at the dipole connection point 22, in each instance, the arithmetical average of the phases of these currents of a dipole pair, which are counted in the same direction, in each instance, possesses the same value, and this value is the same for all the dipole pairs formed in the same plane.

The dipoles 21 are preferably in a straight line and symmetrical to the dipole connection point 22, and run in a horizontal plane, whereby the dipole connection points of multiple dipole pairs are disposed distributed equidistantly on a horizontal circle whose center point forms the common reference point B, and the dipoles 21 are oriented perpendicular to the connection line to the center point of the circle. In this manner, a circular group antenna system 9 is formed, which, according to the reciprocity law, contains a distribution network 10 having multiple outputs 23, whose input is structured as an antenna connection point 3*a*, whereby the dipole connection points are connected with one of the outputs of the distribution networks 10, by way of an electrical line, in each instance, and the dipole pairs are supplied with the same signals, in terms of amplitude and phase (FIG. 13*a*).

In order to produce a sufficiently omnidirectional azimuthal radiation characteristic, the circular group should contain a sufficient number of dipole pairs, and be disposed above an electrically conductive ground plane 6, at a distance in accordance with the configuration of the vertical radiation characteristic (FIG. 13*c*).

An electrically short, vertical monopole 7 can be present at the central phase reference point B. Furthermore, a distribution network 10 is present, whose input in accordance with the reciprocity law forms the antenna connection point 3*b*, whereby the circular group antenna system 9 and the monopole 7 are supplied by way of an electrical line 27, by an output 23 of the distribution network 10, in such a manner that the phases of the current fed into the monopole 7 correspond to the phase position of the currents fed into the circular group antenna system 9, with reference to the common phase reference point B. In this connection, it is practical if multiple short vertical monopoles 7 are present, disposed in pairs, symmetrical to the central phase reference point B, whereby the monopoles are supplied by the distribution network 10, in accordance with the reciprocity law, in such a manner that the arithmetical average of the current phases of the monopoles 7 disposed in pairs, and the phase of the current fed into a central monopole 7, are the same in each instance, with reference to the phase reference point B.

5. In a preferred embodiment, the distribution network 10 is configured for use of the antenna as a diversity reception antenna, in such a manner that both the reception signals of the antenna explained above under Number 4 and those of the vertical monopole 7, and the combined reception signals of the circular group antenna system 9, are alternatively available, separate from one another, in each instance.

However, the distribution network 10 can also be structured for use of the antenna array as a diversity reception antenna, in such a manner that both the reception signals of the antenna explained above under Number 3 and those of the vertical monopole 7, and the reception signals of the loop antenna 14, are alternatively available, separate from one another, in each instance (FIG. 14).

6. Uncoupling at the antenna connection point 3*a*, by way of a symmetrical two-wire line 26 connected to it, as mentioned under Number 3, can also take place in such a manner that the two-wire line is guided to the conductive ground plane 6 within the plane of symmetry SE of the antenna array, oriented perpendicular to the ground plane 6 and symmetrical with reference to the antenna connection point 3*a* (FIG. 6). Also, in place of the vertical monopole 7, the feed line to feed the loop antenna 14 can be disposed in the center Z of the loop antenna 14 as a vertically oriented two-wire line 26, thereby giving the two-wire line the function of a monopole 7, with the loop antenna 14 as a roof capacitor 12, for one thing, and for another thing, the feed to the loop antenna 14 is carried out, whereby two uncouplings for the two antennas formed in this manner are present at the central foot point on the conductive ground plane 6 (FIG. 10). In this connection (in accordance with the reciprocity law), the non-symmetrical power-splitter and phase-shift network 31 can be implemented at the foot point of the antenna array, in that the one conductor of the two-wire line 26 is conductively connected with the conductive ground plane 6 by way of a reactance 41, and the other conductor of the two-wire line 26 is passed to the connection point 28 of the antenna array, and the weighting of the reception of the horizontally and the vertically polarized electrical field is adjusted by means of the selection of the reactance 41 (FIG. 15).

7. In the case of an antenna mentioned under Number 1, in addition, a greater total length hg can be configured for reception of signals at low frequencies—such as AM/FM radio signals, for example—whereby the part of the rod-shaped antenna that goes beyond the length h2 necessary for satellite reception is separated by way of an interruption point 5, and this part, as a function of its length, is provided with one or more interruption points 5 at intervals of less than $\frac{1}{5}\lambda$, and whereby these interruption points are wired up with a resonance circuit 39 tuned to the center frequency $f_m$ of the satellite frequency bands, in each instance, which circuit is at high ohms at this frequency (FIG. 4).

Within the plane of symmetry SE of the antenna array, oriented perpendicular to the ground plane 6 and symmetrically with reference to the antenna connection point 3*a*, at least one linearly or planarly configured antenna can be provided for one or more radio services (FIG. 16).

8. In the case of the antennas mentioned under Number 3 and Number 5, four loop antennas 14 disposed in a square above a conductive ground plane 6 can be present, which are essentially configured as rectangular frame antennas 42, whose frame surfaces are oriented perpendicular to the conductive ground plane 6, and which (in accordance with the reciprocity law) are excited symmetrical to the ground plane, in such a manner that one antenna connection point 3*b* is formed from two foot points of a frame antenna 42, in each instance, and the two antenna connection points 3*b* is supplied by means of a $\lambda/2$-balun line 43 of a frame antenna 42 with an electrical line 27 having the same length, proceeding from the common connection point 28 of the antenna array, in such a manner that all the horizontal frame parts are excited following the same direction of rotation (FIG. 13*b*).

9. In the case of the antenna mentioned under Number 3, the vertical directional diagrams of the monopole configured as a rod antenna and of the loop antenna 14 preferably have the same coverage, and are adjusted, with regard to the main direction, for reception of satellite signals, whereby an adaptation network 25 for the loop antenna 14 and an adaptation network 33 for the monopole are present, in such a form that a common phase center B is formed. The two outputs of the adaptation networks 32, 33 can be connected with the inputs 48, 49 of a 90° hybrid coupler 45, so that one output 46 is configured for LHCP waves, and the other output 47 is configured for RHCP waves (FIG. 19*a*, FIG. 21).

10. The antenna described under Number 6 is preferably configured in such a manner that the loop antenna 14 has two antenna connection points 3*a* that lie opposite one another, and adaptation networks 25 connected with them and situated in the loop plane, whose outputs are switched in parallel, to add up, whereby the non-symmetrical power-splitter and phase-shift network 31 is implemented at the foot point of the antenna array, in that the one conductor of the two-wire line 26 is conductively connected with the conductive ground plane 6 by way of a reactance 41, and the other conductor of the two-wire line 26 is passed to the connection point 28 of the antenna array. By means of the selection of the network 53 from reactances, the weighting of the reception of the horizontally polarized and of the vertically polarized electrical field can be adjusted (FIG. 20). To reverse the polarity of the reception voltage of the loop antenna 14, it can be provided that the reception voltage of the loop antenna 14 can be added with a different sign of the reception voltage from the vertically polarized electrical field, and the reception of LHC and RHC polarized field is optionally possible by means of switching over the LHRCP/RHCP change-over switches 55 (FIG. 22).

With the claims, even if reference numerals are presented, the elements in the claims are not intended to be limited by only those examples in the specification. Accordingly, while only a few embodiments of the present invention have been shown and described, it is obvious that many changes and modifications may be made thereunto without departing from the spirit and scope of the invention.

What is claimed is:

1. An antenna for reception of circularly polarized satellite radio signals, comprising:

a) a multi-dimensional antenna conductor structure;

b) at least one antenna output connector, connected to said multi-dimensional antenna conductor structure;

wherein said multi-dimensional antenna conductor structure comprises a plurality of antenna conductor sections, which, with reference to a spatial reference point common to said antenna conductor sections, are disposed in pairs, symmetrically and extending in the same direction, and wherein said multi-dimensional antenna conductor structure is furthermore configured so that during reciprocal operation of the antenna as a transmission antenna, antenna currents having at least approximately the same size flow in a set of individual pairs of said plurality of antenna conductor sections, and the arithmetical average of the current phases of these antenna currents, counted in the same direction, in each case, in said plurality of antenna conductor sections of each pair, has at least approximately a same value for essentially all the pairs of antenna conductor sections, with reference to a common phase reference point;

at least one antenna connection point, and at least one loop antenna wherein said plurality of antenna conductor sections are electrically connected into said at least one loop antenna forming at least one conductor loop, as a multi-dimensional antenna conductor structure, essentially disposed in a horizontal plane, wherein said at least one antenna connection point of said loop antenna is formed by at least one interruption of said conductor loop;

a substantially horizontal electrically conductive ground plane, wherein said at least one loop antenna is disposed parallel to said ground plane, and wherein the antenna further comprises an electrically short, vertical monopole that is disposed at a phase reference point of said at least one loop antenna, and wherein said at least one antenna connection point comprises at least one antenna connection point for a monopole and an antenna connection point for said at least one loop antenna, and wherein the antenna further comprises an adaptation and phase-shift network, coupled to said at least one antenna output connector and wherein said at least one antenna connection point is coupled to said antenna output connector via said adaptation and phase-shift network, and wherein said adaptation and phase-shift network is configured in such a manner that during reciprocal operation of the antenna as a transmission antenna, it adapts the phases of the currents at said antenna connection points of said vertical monopole and of said at least one loop antenna to one another.

2. The antenna as in claim 1, further comprising at least one capacitor, wherein said at least one conductor loop has at least one interruption bridged by said at least one capacitor, wherein said at least one capacitor serves as an electrically effective shortening of said at least one conductor loop.

3. The antenna as in claim 2, a substantially horizontal electrically conductive ground plane (6), wherein said at least one loop antenna (14) is disposed parallel to said ground plane (6), and wherein the antenna further comprises an electrically short, vertical monopole (7) that is disposed at a phase reference point (B) of said at least one loop antenna (14).

4. The antenna as in claim 3, wherein said adaptation and phase-shift network (25; 31) is configured so that during reciprocal operation of the antenna as a transmission antenna, it superimposes the currents of the monopole (7) and of the loop antenna (14) onto one another, to influence the vertical directional diagram.

5. The antenna as in claim 2, wherein said antenna conductor sections ($\Delta_v$) of said antenna conductor structure (14, 21) are disposed essentially parallel to and at a distance from an electrically conductive ground plane (6) that runs approximately horizontally, and wherein the antenna further comprises an electrically short, vertical monopole (7) that is disposed at a phase reference point of the antenna conductor structure (14, 21) configured during reciprocal operation of the antenna as a transmission antenna, and wherein said antenna connection point of said monopole (7) as well as said antenna connection point of the antenna conductor structure (14, 21), each in themselves, are connected with a change-over switch (37) of an antenna diversity system (38), connected with the antenna output connector (28), either directly or by way of an adaptation network (25).

6. The antenna as in claim 2, wherein said antenna conductor sections of the antenna conductor structure (14) are disposed essentially parallel to and at a distance from said electrically conductive ground plane (6) that runs approximately horizontally, that an electrically short, vertical monopole (26, 32) is disposed at the phase reference point (B) of the antenna conductor structure (14) configured during reciprocal operation of the antenna as a transmission antenna, and that an antenna connection point of the monopole (26, 32) as well as an antenna connection point of the antenna conductor structure (14), each in themselves, are connected by way of an adaptation network (25,33) with inputs of a signal combination circuit, particularly of a 90 hybrid coupler (45), whose outputs, separately from one another, yield a left-rotating circularly polarized reception signal and a right-rotating circularly polarized reception signal.

7. The antenna as in claim 6, further comprising an element (56) that adjusts the attenuation and/or the phase of the reception signal wherein said element is switched in between the antenna connection point of said monopole (7) and/or of the antenna conductor structure (14) and the related input of the signal combination circuit (45), in each instance.

8. The antenna as in claim 1, further comprising a two wire line (26), wherein said at least one antenna connection point (3*a*, 3*b*) of said at least one loop antenna (14) is connected with said at least one antenna output connector (28) at least between a plane of the circuit loop and the electrically conductive ground plane (6), by way of said two-wire line (26), wherein said two-wire line (26) and said antenna connection point (3*a*, 3*b*) are disposed symmetrical to a vertical plane of symmetry (SE) that contains the spatial reference point and the phase reference point (B) configured during reciprocal operation of the antenna as a transmission antenna.

9. The antenna as in claim 8, wherein said two-wire line (26) that runs vertically through the spatial reference point and the phase reference point (B) configured during reciprocal operation of the antenna as a transmission antenna, and is used as a vertical monopole (7) having a roof capacitor (12) formed by the circuit loop, and that an adaptation and phase-shift network (33, 31) that connects said two-wire line (26) with the antenna output connector (28) outcouples both currents of the monopole (7) and of the loop antenna (14), on the electrically conductive ground plane (6).

10. The antenna as in claim 9, wherein said loop antenna (14) has two antenna connection points (3*a*) that lie opposite one another in said plane of symmetry (SE), to which said adaptation and phase shift networks (25) disposed in the loop plane are connected, the outputs of which are switched in parallel, adding up, and connected with said two-wire line.

11. The antenna as in claim 8, wherein there is at least one linearly or planarly configured additional antenna (24) for at least one additional radio service that is disposed within the plane of symmetry (SE).

12. The antenna as in claim 1, further comprising a two wire line (26), wherein said at least one antenna connection point (3*a*, 3*b*) of said at least one loop antenna (14) is connected with said at least one antenna output connector (28) at least between a plane of the circuit loop and the electrically conductive ground plane (6), by way of said two-wire line (26), wherein said two-wire line (26) and said antenna connection point (3*a*, 3*b*) are disposed symmetrical to a vertical plane of symmetry (SE) that contains the spatial reference point and the phase reference point (B) configured during reciprocal operation of the antenna as a transmission antenna.

13. The antenna as in claim 12, wherein said two-wire line (26) that runs vertically through the spatial reference point and the phase reference point (B) configured during reciprocal operation of the antenna as a transmission antenna, and is used as a vertical monopole (7) having a roof capacitor (12) formed by the circuit loop, and that an adaptation and phase-shift network (33, 31) that connects said two-wire line (26) with the antenna output connector (28) outcouples both currents of the monopole (7) and of the loop antenna (14), on the electrically conductive ground plane (6).

14. The antenna as in claim 13, wherein at least one of the two conductors of the two-wire line (26) is conductively connected with the conductive ground plane (6), by way of a reactance (41), for weighting the reception of the horizontally polarized and of the vertically polarized electrical field, and the other of the two conductors is connected with the antenna output connector (28) by way of the adaptation and phase-shift network (33, 31).

15. The antenna as in claim 13, wherein said loop antenna (14) has two antenna connection points (3*a*) that lie opposite one another in said plane of symmetry (SE), to which said adaptation and phase shift networks (25) disposed in the loop plane are connected, the outputs of which are switched in parallel, adding up, and connected with said two-wire line.

16. The antenna as in claim 12, wherein there is at least one linearly or planarly configured additional antenna (24) for at least one additional radio service that is disposed within the plane of symmetry (SE).

17. The antenna as in claim 1, wherein said antenna conductor structure is formed by four essentially rectangular frame antennas (42) disposed in a square above said electrically conductive ground plane (6), the frame surfaces of which run essentially perpendicular to the ground plane (6), that each of the frame antennas defines two foot points, which are connected with the ground plane (6), symmetrical to it, by way of a $\lambda/2$-balun line (43), and that one of the foot points of each frame antenna (42), in each instance, is connected with the antenna output connector (28), following in the same direction of rotation, by way of one of four electrical lines (44) having the same length.

18. The antenna as in claim 1, wherein said antenna conductor sections are disposed in the form of a dipole group comprising multiple dipoles (21) disposed essentially in a common horizontal plane, which are disposed, in pairs, symmetrical to the phase reference point (B) configured during reciprocal operation of the antenna as a transmission antenna, or to the spatial reference point, whereby the pairs of antenna conductor sections are assigned to dipole pairs, in each instance, and that the individual dipoles (21) are configured in such a manner that the antenna currents that occur during reciprocal operation of the antenna in transmission operation, on their dipole conductors, have approximately the same phase, and the arithmetical average of the phases of these antenna currents, which are counted in the same direction, in each instance, possesses the same value, and the values for all the dipole pairs disposed in the common horizontal plane is the same.

19. The antenna as in claim 18, wherein said dipoles (21) of the dipole group are straight dipoles that are symmetrical to their dipole connection points (3*a*), in each instance, whereby the dipole connection points (3*a*) are disposed in the common horizontal plane, on a circle around the phase reference point (B) or the spatial reference point, and that the dipole connection points (3*a*, 3*b*) are connected with the antenna output connector (28) by way of a connection network (10).

20. The antenna as in claim 19, wherein said dipoles (21) of the dipole group are disposed parallel to and at a distance from an electrically conductive ground plane (6) that runs approximately horizontally, that an electrically short, vertical monopole (7) is disposed at the phase reference point (B) of the dipole group that is configured during reciprocal operation of the antenna as a transmission antenna, and that an antenna connection point of the monopole (7) and an output connector of the connection network (10) are connected with the antenna output connector (28) by way of an adaptation and phase-shift network (3A, 3B), which adapts the phases of the currents that occur at the antenna connection point of the monopole and the output connector of the connection network (10) to one another during reciprocal operation of the antenna as a transmission antenna.

21. The antenna as in claim 20, further comprising an adaptation and phase-shift network (31, 33) that is configured so that it superimposes the currents of the monopole (7) and of the connection network (10) onto one another, to influence the vertical directional diagram.

22. The antenna as in claim 1, wherein said antenna conductor sections ($\Delta_v$) of said antenna conductor structure (14, 21) are disposed essentially parallel to and at a distance from said electrically conductive ground plane (6) that runs approximately horizontally, and wherein the antenna further comprises an electrically short, vertical monopole (7) that is disposed at a phase reference point of the antenna conductor structure (14, 21) configured during reciprocal operation of the antenna as a transmission antenna, and wherein said antenna connection point of said monopole (7) as well as said antenna connection point of the antenna conductor structure (14, 21), each in themselves, are connected with a change-over switch (37) of an antenna diversity system (38), connected with the antenna output connector (28), either directly or by way of an adaptation network (25).

23. The antenna as in claim 1, wherein said antenna conductor sections of the antenna conductor structure (14) are disposed essentially parallel to and at a distance from said electrically conductive ground plane (6) that runs approximately horizontally, that an electrically short, vertical monopole (26, 32) is disposed at the phase reference point (B) of the antenna conductor structure (14) configured during reciprocal operation of the antenna as a transmission antenna, and that an antenna connection point of the monopole (26, 32) as well as an antenna connection point of the antenna conductor structure (14), each in themselves, are connected by way of an adaptation network (25,33) with inputs of a signal combination circuit, particularly of a 90 hybrid coupler (45), whose outputs, separately from one another, yield a left-rotating circularly polarized reception signal and a right-rotating circularly polarized reception signal.

24. The antenna as in claim 23, further comprising an element (56) that adjusts the attenuation and/or the phase of the reception signal wherein said element is switched in between the antenna connection point of said monopole (7) and/or of the antenna conductor structure (14) and the related input of the signal combination circuit (45), in each instance.

25. The antenna as in claim 1, wherein said antenna conductor sections for forming a three-dimensional antenna conductor structure are connected with one another, into a plurality of electrically short, vertical monopoles (7, 11), disposed over an essentially horizontal, electrically conductive ground plane (6), at equal angle intervals (W) from one another, on a circle (K), as well as a central, electrically short, vertical monopole (7) disposed in the center of the circle, which forms an antenna connection point (28) of the antenna structure, in such a manner that during reciprocal operation of the antenna as a transmission antenna, the phase reference point (B) is configured in the center of the circle.

26. The antenna according to claim 25, wherein said monopoles (11) disposed on the circle (K) are configured as parasitic radiators (11).

27. The antenna according to claim 25, wherein said monopoles (7) disposed on said circle (K) form additional antenna connection points, which, together with the antenna connection point of said central monopole (7), are connected with said antenna output connector (28) by way of a network (10), wherein at least said monopoles (7) disposed on said circle (K) have at least one interruption point, in each instance, which is bridged by a reactance element (8).

* * * * *